US008336673B2

(12) United States Patent
Zanzie et al.

(10) Patent No.: US 8,336,673 B2
(45) Date of Patent: Dec. 25, 2012

(54) MUFFLER, MUFFLER INSERT, AND METHODS AND APPARATUS FOR MAKING

(75) Inventors: Daniel Zanzie, Green Bay, WI (US); Charles L. Bauer, Mayfield, OH (US)

(73) Assignee: Bay Industries Inc., Green Bay, WI (US)

( * ) Notice: Subject to any disclaimer, the term of this patent is extended or adjusted under 35 U.S.C. 154(b) by 0 days.

(21) Appl. No.: 12/803,879

(22) Filed: Jul. 7, 2010

(65) Prior Publication Data

US 2012/0006617 A1 Jan. 12, 2012

(51) Int. Cl.

| | |
|---|---|
| ***F01N 1/10*** | (2006.01) |
| ***F01N 1/24*** | (2006.01) |
| ***B29C 53/58*** | (2006.01) |
| ***B29C 65/00*** | (2006.01) |

(52) U.S. Cl. ..... 181/256; 156/86; 156/173; 181/252

(58) Field of Classification Search ..... 181/256, 181/252; 156/173, 86; 264/299

See application file for complete search history.

(56) References Cited

U.S. PATENT DOCUMENTS

| | | | | |
|---|---|---|---|---|
| 3,074,802 | A * | 1/1963 | Alexander et al. | 106/38.3 |
| 3,107,403 | A * | 10/1963 | Moore | 164/16 |
| 3,109,511 | A * | 11/1963 | Slayter et al. | 181/245 |
| 3,121,268 | A * | 2/1964 | Rubens | 164/526 |
| 3,340,115 | A * | 9/1967 | Rubenstein | 156/86 |
| 3,425,982 | A * | 2/1969 | Fink | 524/413 |
| 3,449,188 | A * | 6/1969 | Huff | 156/173 |
| 3,489,626 | A * | 1/1970 | Rubenstein | 156/86 |
| 3,502,529 | A * | 3/1970 | Spangaro et al. | 156/172 |
| 3,520,749 | A * | 7/1970 | Rubenstein | 156/173 |
| 3,525,844 | A * | 8/1970 | Johnson | 219/73 |

(Continued)

FOREIGN PATENT DOCUMENTS

| | | |
|---|---|---|
| DE | 10002380 | 8/2001 |

(Continued)

OTHER PUBLICATIONS

Owens Corning, System information, OC Advantex 162A, SC3000 (162A) Single—End roving, High thermal & corrosion resistance designed for Silentex noise control solutions, Dec. 2000, 4 pages.

(Continued)

*Primary Examiner* — David Warren
*Assistant Examiner* — Christina Russell
(74) *Attorney, Agent, or Firm* — Thomas D. Wilhelm; Wilhelm Law, S.C.

(57) ABSTRACT

A fiberglass-binder insert is made by fabricating a shape-constant, cured fiberglass-binder mixture, into a shape-constant insert core, and shrink-wrapping the core while leaving exposed any bore which extends into the core. The core is fabricated by mixing fiberglass and uncured binder in a mixer, dropping the mixture into a conforming guide such as a funnel, and moving the mixture through the conforming guide and into a mold. A tamper can tamp the mixture to move the mixture from the conforming guide into the mold, and to distribute portions of the mixture vertically in the mold. Rotation of the mold effects circumferential distribution of the mixture in the mold. The mixture in the mold is heated to cure the binder, thus to establish a fixed shape of the resultant core product. A shrink film is shrunk about the core, providing apertures in the shrunk film at bore openings in the core.

62 Claims, 10 Drawing Sheets

U.S. PATENT DOCUMENTS 3,532,132 A * 10/1970 Rubenstein ..... 138/172
3,590,111 A * 6/1971 Gebefugi ..... 264/234
3,613,830 A 10/1971 Hubbell, III
3,619,322 A 11/1971 Fleissner
3,669,638 A * 6/1972 Wong et al. ..... 264/115
3,740,284 A * 6/1973 Dillon ..... 156/171
3,813,371 A * 5/1974 Bozer et al. ..... 525/352
3,957,410 A * 5/1976 Goldsworthy et al. ..... 425/183
3,980,484 A * 9/1976 Shaw ..... 524/5
4,569,471 A 2/1986 Ingemansson et al.
4,685,873 A * 8/1987 Willard et al. ..... 264/83
4,774,985 A 10/1988 Broadbelt et al.
4,788,230 A * 11/1988 Mudge ..... 523/219
4,824,507 A * 4/1989 D'Amico ..... 156/245
4,846,302 A 7/1989 Hetherington
4,898,770 A 2/1990 Dunbar
4,952,366 A 8/1990 Gelin
5,009,941 A * 4/1991 Pollet et al. ..... 428/36.3
5,036,585 A 8/1991 Schweinfurth
5,041,260 A * 8/1991 Johnson et al. ..... 264/510
5,264,170 A * 11/1993 Strachan ..... 264/70
5,338,169 A * 8/1994 Buckley ..... 425/82.1
5,407,631 A * 4/1995 Salisbury ..... 264/517
5,418,339 A 5/1995 Bowen et al.
5,545,279 A 8/1996 Hall et al.
5,766,541 A * 6/1998 Knutsson et al. ..... 264/571
5,976,453 A 11/1999 Nilsson et al.
6,053,276 A 4/2000 D'Amico, Jr. et al.
6,138,791 A * 10/2000 Zanzie ..... 181/252
6,241,043 B1 * 6/2001 Goertz ..... 181/252
6,319,444 B1 11/2001 Kirk
6,344,160 B1 * 2/2002 Holtzberg ..... 264/102
6,607,052 B2 8/2003 Brandt et al.
7,661,247 B2 * 2/2010 Schwabel et al. ..... 53/472
7,730,996 B2 * 6/2010 Van De Flier et al. ..... 181/256
7,934,580 B2 * 5/2011 Van de Flier et al. ..... 181/246
7,942,237 B2 * 5/2011 van de Flier et al. ..... 181/256
2001/0011780 A1 8/2001 Knutsson
2002/0079161 A1 * 6/2002 Curtice et al. ..... 181/252
2002/0175447 A1 * 11/2002 Bellasalma ..... 264/328.6
2004/0137175 A1 * 7/2004 Dillon et al. ..... 428/34.4
2005/0279570 A1 * 12/2005 Van Arsdale ..... 181/256
2007/0240932 A1 * 10/2007 Van De Flier et al. ..... 181/228
2007/0240934 A1 * 10/2007 Van de Flier et al. ..... 181/252
2008/0142295 A1 * 6/2008 Huff ..... 181/256
2008/0290547 A1 11/2008 Kashikar et al.
2009/0014236 A1 * 1/2009 Van De Flier et al. ..... 181/256

FOREIGN PATENT DOCUMENTS

EP 0446064 9/1991
EP 0931971 7/1999
EP 1338769 8/2003
GB 2158001 11/1985
JP 2008073875 4/2008

OTHER PUBLICATIONS

Hexion Specialty Chemicals, Hexion Specialty Chemicals, Inc., Certificate of Analysis, Material Safety Data Sheet, Durite AD-5524, Current Issue: Aug. 22, 2005, Version: 4, Printed Aug. 23, 2005, 8 pages.

* cited by examiner

MUFFLER, MUFFLER INSERT, AND METHODS AND APPARATUS FOR MAKING

BACKGROUND

This invention pertains to mufflers. In general, a muffler has an outer shell, generally steel, which encloses a medium which absorbs and/or otherwise attenuates the sound emitted by e.g. an internal combustion engine. An inlet pipe feeds exhaust gases from the engine into the muffler. An exit pipe carries the exhaust gases away from the muffler.

The medium inside the muffler can be as minimal as the air which is inherently contained inside the muffler shell, namely the exhaust gases and/or shock waves pass/expand from the inlet pipe into the bulk of the shell cavity, and then pass from there into the exit pipe.

In other embodiments, the medium includes a multiple-pass path of pipes and baffles inside the muffler shell, where the multiple-pass path carries the exhaust gases through an elongate journey through the muffler, and where the length of the path, in combination with the internal pipe configuration, and other acoustic design properties, collectively contribute to sound attenuation in the muffler.

More commonly, the muffler shell is packed with a fibrous packing material such as fiberglass which may be separately fabricated as an "insert". The exhaust gases, and/or the shock waves in the exhaust gases, are allowed and/or directed to flow into and/or through the fibrous packing material whereby the fibrous material absorbs/attenuates a portion of the sound.

This invention pertains, specifically, not only to mufflers in general, but also to muffler inserts, and methods and apparatus for fabricating muffler inserts.

In general, the process of reducing the intensity of the sound emitted by an engine, in a fiberglass-packed muffler, relates to the ability to disburse the sound waves into the medium materials so the medium can absorb and disburse the energy of the sound waves. While fiberglass is typically used as the fibrous packing material medium, other high temperature materials can be used in place of the fiberglass.

The muffler shell, which is packed with fiberglass, is also known as a canister. The inlet pipe, leading into the muffler, carries the exhaust gases from the engine into the muffler. The exit pipe, leaving the muffler, receives the exhaust gases which pass through the muffler, and passes those exhaust gases to downstream portions of the exhaust system. The exit pipe leaving the muffler may be an extension of the inlet pipe which carries the exhaust gases into the muffler. In the alternative, the exhaust gases may traverse one or more additional pipes inside the muffler whereby there may or may not be additional exhaust-gas carrying pipes and/or baffles inside the muffler shell, depending on the specifications of the particular muffler; and the exit pipe may not be the same pipe as the inlet pipe.

Some or all of the space inside the muffler shell, which is not occupied by the inlet pipe, the exit pipe, or any other internal structure inside the canister, is desirably occupied by uniformly packed fiberglass, which fiberglass provides a substantial portion of the sound attenuation properties of the muffler.

While some mufflers have a plurality of internal metal baffles and/or pipes which direct the exhaust gases in a tortuous path, other mufflers, as is the case in the embodiments illustrated, attenuate the sound in the exhaust gases as the pipe carrying the exhaust gases makes a straight-line pass through the muffler. The primary means for attenuating the sound in a straight-through muffler, such as in the embodiments illustrated herein, is to surround the inlet pipe, and/or another pipe inside the muffler, with a pack of fiberglass or other fibrous material. The fiberglass pack is surrounded by the outer shell such that the fiberglass pack is held between the outer shell and an exhaust-gas-carrying tube.

In some instances, the fiberglass insert is packaged in a plastic bag such that the plastic layer generally protects a worker's hands from the harsh affects of the fiberglass on human skin. When a muffler containing such insert is incorporated into an engine exhaust system, and the engine is activated, the heat from the exhaust gases melts and burns off the plastic bag, and at about 600 degrees F. sustained temperature, the gases also burn off any phenolic resin/binder in the fiberglass pack, leaving only the fiberglass as the "pack" inside the muffler. Once the fiberglass is released from any such binder as the binder and plastic film are burned off, the fiberglass, in general, expands to fill the space into which the insert was inserted, namely the space being occupied inside the muffler.

Restated, as a fiberglass pack is fabricated, certain transverse stresses are imposed on the individual strands of fiberglass. Those transverse stresses are maintained in the insert by the combination of any cured resin and any surrounding plastic bag. Once the bag and binder are burned off inside the muffler, the resilient nature of the transverse stresses, on the strands, cause the strands to move in transverse restoration directions until otherwise restrained by other strands, or by the muffler shell or pipes. Thus, when any binder and any bag are burned off, the fiberglass pack, as a whole, expands to a less-stressed condition, and correspondingly better fills the available space inside the muffler shell.

The efficiency with which a muffler attenuates sound depends in part on the uniformity of the density of the fiberglass in the fiberglass pack at steady state operation of the muffler. Uniformity of fiberglass density also influences uniformity of temperature distribution inside the muffler as well as at the muffler shell, thus effecting thermal stress distribution in the muffler, which influences use life of the muffler.

The extent to which the expanded fiberglass density is uniform throughout the available space inside the muffler shell, depends in part on the ability of the insert to conform to the available space, and in part on the uniformity of the density of the fiberglass in the insert as the insert is assembled into the muffler shell.

The problem addressed by the invention is that of creating a reproducible fiberglass insert which resides between the exhaust-gas-carrying tube and the outer muffler shell, starting with continuous fiberglass rovings as the raw material from which the insert is made and which provides desirably uniform density distribution of the fiberglass during steady-state operation of the muffler, while providing suitable safety to workers who install such inserts in the process of assembling mufflers.

Known processes by which fiberglass-based products are made and/or filled into muffler shells result in uneven distribution of the fiberglass inside the muffler shell, or distribution which is not reliably repeatable, such that, when the binder and/or plastic burn off, the fiberglass density is not reliably evenly distributed in the occupied space, which results in hot spots in the muffler, or there is variation from muffler to muffler, or from one production run to a subsequent production run.

Thus it is desirable to provide a method of uniformly distributing the fiberglass-binder mixture in an insert.

More specifically, it is desirable to provide a method of uniformly distributing a fiberglass-binder mixture in a mold which receives the fiberglass-binder mixture and provides a shape-constant core for the insert.

It is also desirable to provide a process by which uniformity and density of the fiberglass-binder core is reliably reproducible over an extended period of time.

Because of the known detrimental effects of fiberglass on human skin, it is also desirable to provide a method of fabricating a generally shape-constant muffler insert while providing a surface on the insert which limits the exposure of a worker's skin to the fiberglass used in the insert.

It is further desirable to provide a method of assembling a muffler product which includes assembling, into a muffler shell, a generally shape-constant muffler insert wherein a fiberglass-binder mixture is generally uniformly distributed in a core of the insert, and wherein a shrink film generally surrounds the outer surface of the core.

It is further desirable to provide a method of fabricating a muffler insert article, and muffler into which the insert article has been assembled, wherein the quality of the insert product is reliably reproducible.

It is yet further desirable to provide apparatus adapted to fabricate a fiberglass-based muffler insert and wherein the insert fabricated using such apparatus defines a generally uniform distribution of fiberglass throughout the volume defined by such insert, and wherein the insert is reliably reproducible.

It is further desirable to provide a cyclone mixer to mix fiberglass and binder, in cooperating combination with one or more funnels adapted to convey the fiberglass-binder mixture to a mold.

It is yet further desirable to provide a tamper which tamps the fiberglass-binder mixture into the mold, optionally through the funnel.

It is still further desirable to rotate the mold, either while the fiberglass-binder mixture is being conveyed from the mixer to the mold, or after a first charge of the mixture has been conveyed to the funnel and before a second subsequent charge of the mixture has been conveyed to the funnel.

SUMMARY

This invention provides mufflers, muffler inserts, and methods and apparatus for fabricating muffler inserts.

In a first family of embodiments, the invention comprehends a method of charging a cavity in a mold with a fiberglass-binder mixture wherein the mold cavity is adapted and configured to receive the fiberglass-binder mixture, and wherein the mold underlies a conforming guide such as a funnel which conforms the mixture mass to the horizontal cross-section profile of the underlying mold cavity. The method comprises making a mixture of fiberglass strand material and curable binder in a mixer; moving a charge of the mixture from the mixer into the funnel; and as a first tamping operation, driving a tamper, and thus the fiberglass-binder mixture, into the cavity in the underlying mold, the mold cavity having a generally open top, a generally closed bottom, a full height between the top and the bottom, and a mid-point height generally midway between the top of the cavity and the bottom of the cavity.

In some embodiments, the fiberglass strand material comprises chopped strand fiberglass.

In some embodiments, the method further comprises driving the tamper into the mold, to approximately the bottom of the cavity, withdrawing the tamper, and executing a second tamping operation, including driving a tamper into the mold, including stopping the driving of the tamper at the mid-point of the height of the cavity.

In some embodiments, the method further comprises moving a second charge of the fiberglass-binder mixture from the mixer into the funnel and executing a third tamping operation, after the second tamping operation, which includes stopping the driving of the tamper at the mid-point of the height of the cavity.

In some embodiments, the moving of the charge from the mixer into the funnel comprises dropping the mixture by gravity from the mixer into the funnel.

In some embodiments, the invention comprehends a method of fabricating a glass fiber strand material molded insert core comprising charging the mold; curing the binder in the mold and thus binding the glass fiber strand material into a cohesive molded insert core having generally the shape of the mold cavity; and removing the molded insert core from the mold.

In some embodiments, the method further comprises enclosing the molded core in a plastic shrink film and shrinking the film about an outwardly-facing surface of the molded core such that the film closely surrounds substantially the entirety of the outwardly-facing surface of the molded core.

In some embodiments, the combination of the molded insert core, surrounded by the shrunk film, comprises a muffler insert.

In some embodiments, the molded insert core has a bore extending therethrough, including first and second ends of the bore at first and second spaced locations at the outwardly-facing surface of the molded insert core, the molded insert core thus having an inwardly-facing surface facing across the bore, the method further comprising providing for apertures in the shrunk film at ends of the bore, whereby the ends of the bore are open to the ambient environment.

In some embodiments, the method includes teeth at the leading edge of the tamper, where the teeth extend, in a direction of movement of the tamper, from the leading edge of the tamper, a distance corresponding to about 25 percent to about 75 percent of the height of the mold cavity.

In some embodiments, the method further comprises, while moving the charge of the mixture from the mixer into the funnel, rotating the funnel, and optionally rotating the mold.

In some embodiments, the method further comprises mounting the mold on a jig, the jig being mounted on a rotating table, the jig having a driven gear adapted to drive rotation of the rotating table and thus rotation of the mold, and rotating the turntable so as to move the mold and the funnel under the mixer and to engage the driven gear with a drive gear and thereby drive rotation of the mold while moving the charge of the mixture into the funnel.

In some embodiments, the driving of the tamper, and thus the driving of the fiberglass-binder mixture, into the cavity in the underlying mold comprises driving the tamper through the funnel.

In some embodiments, the method thus comprises distributing the mixture both vertically and circumferentially in the mold.

In some embodiments, the method further comprises determining mass of the first charge in the mold, computing a target add-on for the second charge based on the mass of the first charge, and feeding binder and fiberglass quantities to the mold according to the computed target add-on for the second charge.

In some embodiments, the method comprises controlling the mass of a given charge fed to the cyclone by specifying the number of revolutions of at least one of a fiber feed motor and a resin feed motor.

In a second family of embodiments, the invention comprehends a method of fabricating a fiberglass-based muffler insert. The method comprises charging fiberglass strand material and a curable binder into a mold, the mold having a cavity, the cavity having a top, a bottom, a full height between the top and the bottom, and a mid-point height generally midway between the top of the cavity and the bottom of the cavity; curing the fiberglass-binder mixture thus to make a generally shape-constant insert core; removing the generally shape-constant insert core from the mold; and subsequent to removing the generally shape-constant insert core from the mold, shrink-wrapping the molded insert core in a plastic shrink film.

In some embodiments, the fabricating of the muffler insert product further comprises chopping one or more fiberglass strand bundles and thereby obtaining chopped strand fiberglass, advancing the chopped strand fiberglass, and powdered binder material, into a cyclone mixer and mixing the binder and the chopped strand fiberglass in the cyclone mixer to make the fiberglass-binder mixture, dropping a charge of the mixture into an underlying funnel while rotating both the funnel and the mold, driving a tamper into the mold and thereby tamping the mixture in the mold, curing the binder and thereby creating a generally shape-constant muffler insert precursor product, removing the insert core from the mold, and shrink wrapping the insert core in a shrink film while providing for apertures in the shrink film at any bore openings in the insert core.

In a third family of embodiments, the invention comprehends a method of preparing a mixture of fiberglass strand material and curable binder. The method comprises feeding fiberglass strand material and curable binder into a mixer which has no moving mixing parts; and mixing the fiberglass strand material and the curable binder in the mixer and thereby forming a fiberglass-binder mixture.

In some embodiments, the method further comprises releasing the fiberglass-binder mixture from the mixer; receiving and consolidating the mixture in a cavity in a mold, the cavity having a generally open top, a generally closed bottom, and a mid-point height, mid-point between the top of the cavity and the bottom of the cavity; curing the curable binder to produce a cured, molded fiberglass product; and removing the cured molded fiberglass product, as a generally shape-constant product, from the mold.

In some embodiments, the method further comprises releasing of the mixture from the mixer by allowing the mixture to drop by gravity through the bottom of the mixer.

In some embodiments, the mixer comprises a cyclone mixer.

In some embodiments, the method further comprises dropping the released mixture into a funnel and moving the mixture from the funnel into the mold.

In some embodiments, the method comprises, while the funnel is receiving the mixture, rotating the funnel about an axis consistent with the direction in which the fiberglass mixture is being moved toward the funnel.

In some embodiments, the method comprises providing multiple charges of the fiberglass-binder mixture to the mold in the process of charging the mold, and including rotating the mold between charges so as to provide first and second ones of the charges in respective first and second different horizontally-distinct portions of the mold.

In a fourth family of embodiments, the invention comprehends a method of assembling a muffler product, including assembling a sound-attenuating muffler insert into a muffler shell, the muffler shell having an opening therein adapted to receive the insert, wherein an exhaust-gas-carrying exhaust pipe extends into the insert in the fully assembled muffler product. The method comprises providing a such insert, the insert comprising an insert core comprising a shape-constant cured mixture of fiberglass and curable binder, the insert having an outer surface and being sized and configured, as a generally shape-constant product, to fit into the muffler shell, the insert core having a bore extending therethrough, including first and second ends of the bore at first and second spaced locations at the outer surface of the insert core, the insert core thus having an inwardly-facing surface facing across the bore and an outwardly-facing surface facing away from the insert, a shrink film overlying substantially all of the outwardly-facing surface, first and second apertures being provided in the shrink film at the ends of the bore, whereby the ends of the bore are open to the ambient environment; moving the insert into the muffler shell through the opening in the muffler shell; assembling the exhaust pipe into the insert through one of the first and second apertures in the film at one of the first and second ends of the bore whereby the exhaust pipe, as initially so assembled to the insert, is in direct contact with the fiberglass/binder mixture at the inwardly-facing surface of the bore; and finishing the assembling of the muffler, as necessary, to provide the finished muffler product.

In a fifth family of embodiments, the invention comprehends a molded fiberglass-based sound-attenuating muffler insert, comprising a generally shape-constant molded fiberglass muffler insert core comprising a cured mixture of curable binder and fiberglass, the molded fiberglass muffler insert core having an outer surface configured to interface with an inside surface of a muffler shell into which the insert is adapted to be assembled so as to provide fiberglass-based sound attenuation in such muffler when such muffler is fully assembled; and a shrink film covering shrunk about the shape-constant muffler insert core and covering substantially all of the outer surface of the muffler insert core, whereby the shrink-wrapped muffler insert, including the film covering, maintains a constant shape configured to interface with the inside surface of the muffler shell, and whereby the film covering provides a film outer surface which generally protects a user from coming into direct contact with the fiberglass in the insert while working with the insert to assemble the insert into the muffler shell.

In some embodiments, when a muffler embodying such insert receives hot gases from an internal combustion engine, temperature variation within the insert at a given distance from a heat source in the muffler is moderated by uniformity of distribution of the fiberglass in the insert.

In some embodiments, the insert core has been fabricated by using a tamper a first time to drive at least a portion of an uncured mixture of chopped fiberglass and binder to substantially a bottom of a mold cavity, and subsequently using a tamper a second time to drive at least a portion of such uncured mixture to a mid-point height of such mold cavity, and subsequently curing the fiberglass-binder mixture.

In some embodiments, the tamper used, at least one of the first and second times the mixture was tamped, includes teeth at a leading edge of the tamper.

In some embodiments, the muffler insert further comprises a bore extending into the muffler insert core, an end of the bore extending to the outer surface of the muffler insert core, an aperture being provided in the shrink film at the end of the bore at the outer surface of the muffler insert core.

In some embodiments, the size of the aperture in the shrink film at the bore generally corresponds to the size of the cross-section of the bore at the bore opening.

In some embodiments, the invention further comprises a bore extending through the muffler insert core, the bore having first and second open ends at first and second spaced locations on the outer surface of the muffler insert core, whereby the ends of the bore are open to the ambient environment, the shrink film covering overlying substantially the entirety of the outer surface of the muffler insert core, an aperture being provided in the shrink film at each of the first and second ends of the bore, the sizes of the apertures in the shrink film at the bore open ends generally corresponding to at least the sizes of the cross-section of the bore at the respective bore openings.

In some embodiments, the invention comprehends a muffler, comprising an outer muffler shell; and a muffler insert as described herein, inside the shell.

In a sixth family of embodiments, the invention comprehends apparatus adapted to fabricate a muffler insert. The apparatus comprises a source of chopped fiberglass strand material; a source of curable binder; a mixer adapted to mix the fiberglass strand material and the curable binder, thereby to form a mixture of the fiberglass strand material and the curable binder; a funnel adapted to receive the mixture from the mixer; a mold adapted and positioned to receive the mixture from the funnel, into a mixture-receiving cavity in the mold, the cavity having a top, a bottom, and a height between the top of the cavity and the bottom of the cavity; and a heat source adapted to heat the mixture in the mold and thereby to develop the mixture into a shape-constant molded fiberglass product.

In some embodiments, the mixer comprises a cyclone mixer.

In some embodiments, the funnel is positioned under the mixer such that a charge of the mixture can be released from the mixer and fall directly by gravity into the funnel.

In some embodiments, a rotating drive causes rotation of the funnel, and optionally rotation of the mold, while the mixture is being released from the mixer into the funnel whereby the rotation provides generally uniform distribution of the mixture in the funnel, as well as optionally in the underlying mold.

In some embodiments, the apparatus further comprises a tamper adapted to proceed into the cavity in the mold, optionally to pass through the funnel, and thereby to tamp the mixture in and/or into the mold cavity, the tamper having a leading edge, a plurality of teeth extending, from the leading edge, in a direction of movement of the tamper, a distance corresponding to about 25 percent to about 75 percent of the height of the cavity in the mold.

In some embodiments, the apparatus further comprises a source of shrink film, apparatus for forming heat seals in the shrink film, and a heat source adapted to shrink the shrink film about the molded fiberglass product.

In some embodiments, the apparatus is adapted to distribute the mixture both vertically and circumferentially in the mold.

Figure 1:
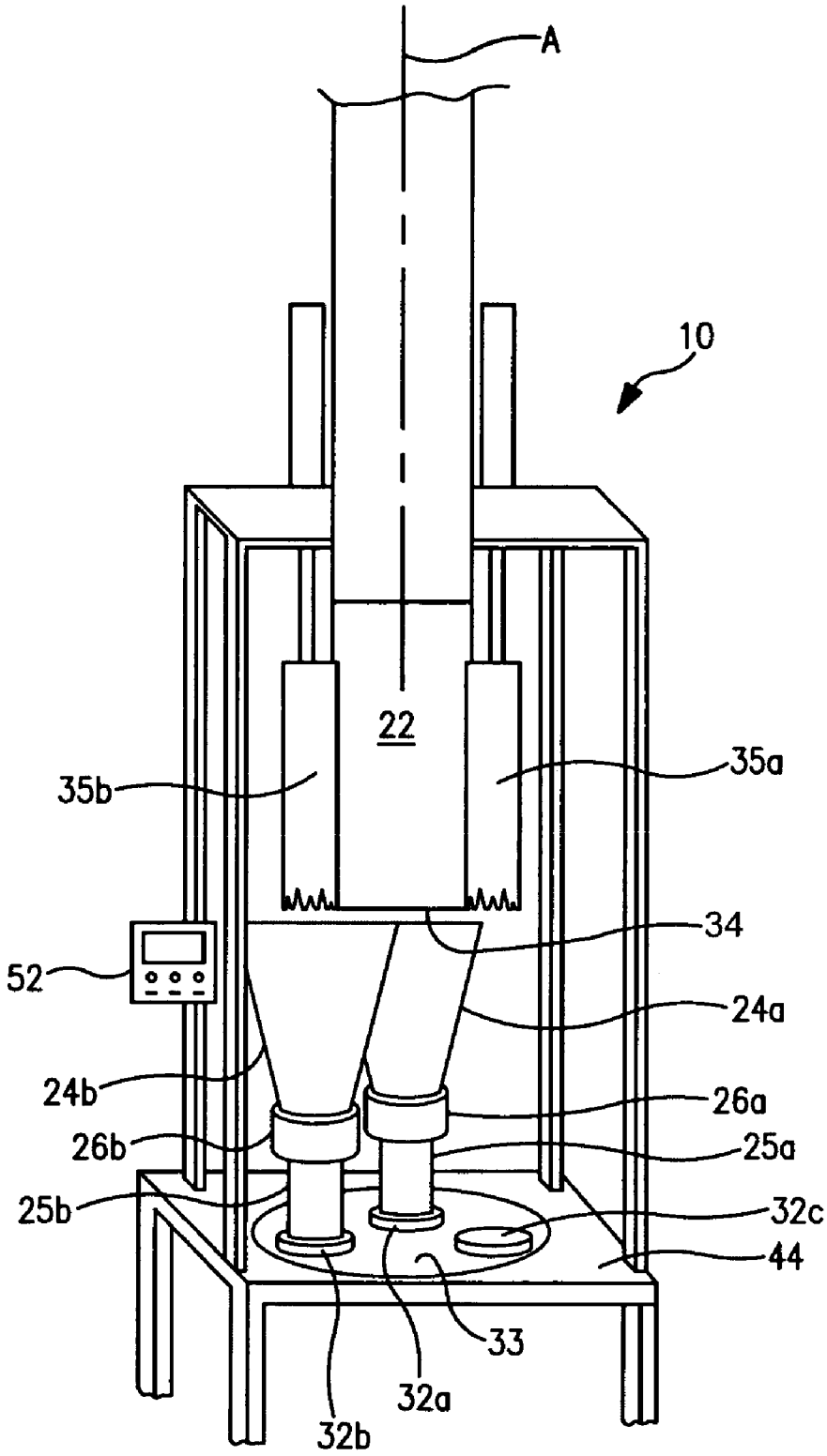
FIG. 1 shows a representative elevation view of a first embodiment of apparatus of the invention adapted to create a fiberglass-binder mixture and to convey such mixture into a mold.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

The basic concept of the invention is to chop continuous fiberglass rovings to make defined-length strands of fiberglass material, to mix the chopped fiberglass strands with e.g. phenolic binder powder to make a mixture, to mechanically move the mixture of binder and chopped fiberglass into the mold so as to distribute the fiberglass-binder mixture generally uniformly about the circumference or other area of the mold, and to influence uniformity of distribution of the fiberglass mixture generally top to bottom in the mold, in the mold cavity. The mold, bearing the fiberglass-binder mixture, is then heated to cure the binder, which sets, establishes, a fixed shape of the resultant fiberglass-binder mixture. The resultant molded product, which is then generally shape constant, is de-molded and forms the core of the finished muffler insert. The core is shrink-wrapped in e.g. shrinkable polyethylene or other plastic film. During the process of heat shrinking the film, side edges of the overlying and underlying film shrink about apertures which represent the surface expression of any through-bore which extends through the molded fiberglass-binder core.

In the resultant product, a shrunk plastic film overlies the fiberglass-binder core, providing a plastic-wrapped insert which fits closely inside the inner dimensions of the shell of the muffler, and closely about/outside the muffler inlet tube. When the insert, as part of the fully-assembled muffler, is initially exposed to the hot exhaust gases of a vehicle engine for an extended length of time, such as an hour or so, the plastic shrink film burns off. The binder burns off at sustained temperatures of at least 600 degrees F. Once the binder and plastic film have burned off, all that remains is the chopped fiberglass. The process by which the insert has been fabricated, and loaded into the muffler, in the invention, results in a superior uniformity of density in the fiberglass which remains inside the muffler shell after the binder and plastic burn off. Such uniformity of density contributes to efficient sound attenuation as well as to uniformity of temperature distribution in the muffler as well as about the muffler shell.

Figure 2:
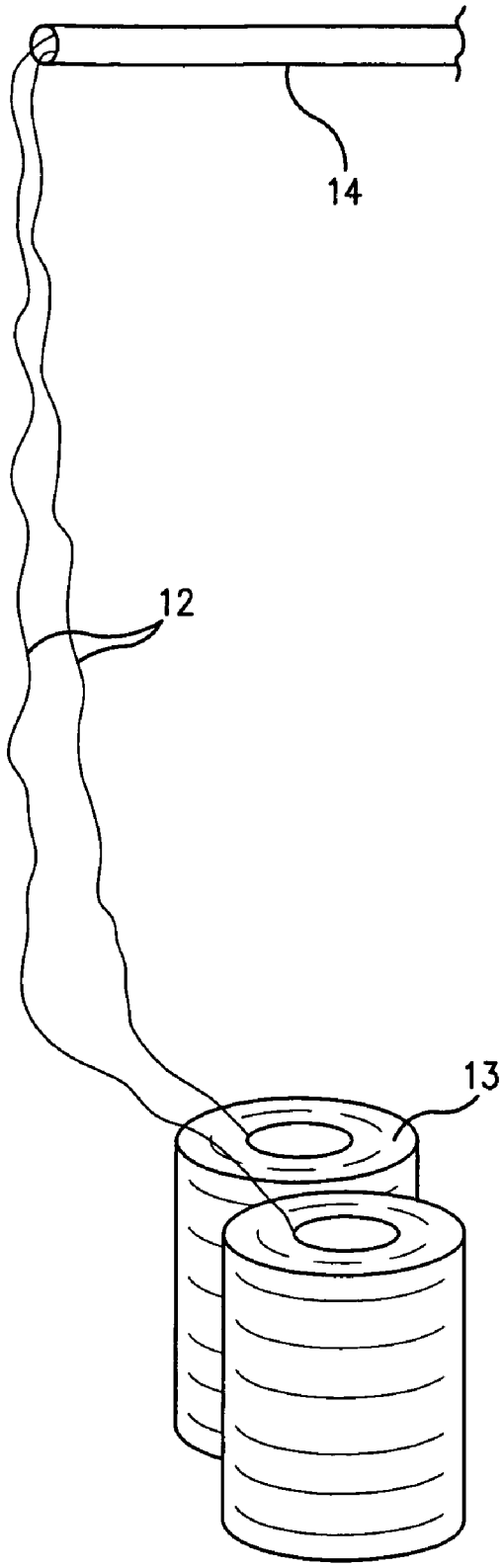
FIG. 2 shows a representative pictorial view of a pair of spools of fiberglass rovings feeding continuous strand bundles of fiberglass rope into a feed pipe which leads to a chopper, and thence to the remaining apparatus illustrated in FIG. 1.

Turning now to the drawings, FIG. 1 shows an elevation view of the front of mold-filling machinery of the invention, generally designated as 10. FIG. 2 shows a pictorial view of a portion of the back of the same machinery. FIG. 2 specifically shows two strands of the fiberglass roving/rope 12 being fed from a pair of spools 13 of such rovings to an intake pipe 14. The number of strands and the number of spools are readily selected by those skilled in the art. Rovings 12 pass through intake pipe 14 to a chopper 16 shown in FIG. 3. Chopper 16 is driven by a motor 17 through shaft 18. In the chopper, the continuous fiberglass rope is chopped, in the illustrated embodiment, into 3.5 inch lengths. The lengths of the chopped fiber will, of course, depend on the needs of the mold into which the fiberglass will eventually be fed, whereby shorter fiber lengths as short as about 1 inch, 2 inches, or 3 inches, and longer fiber lengths such as 4 inches or 5 inches, or as long as about 6 inches, are contemplated.

Figure 3:
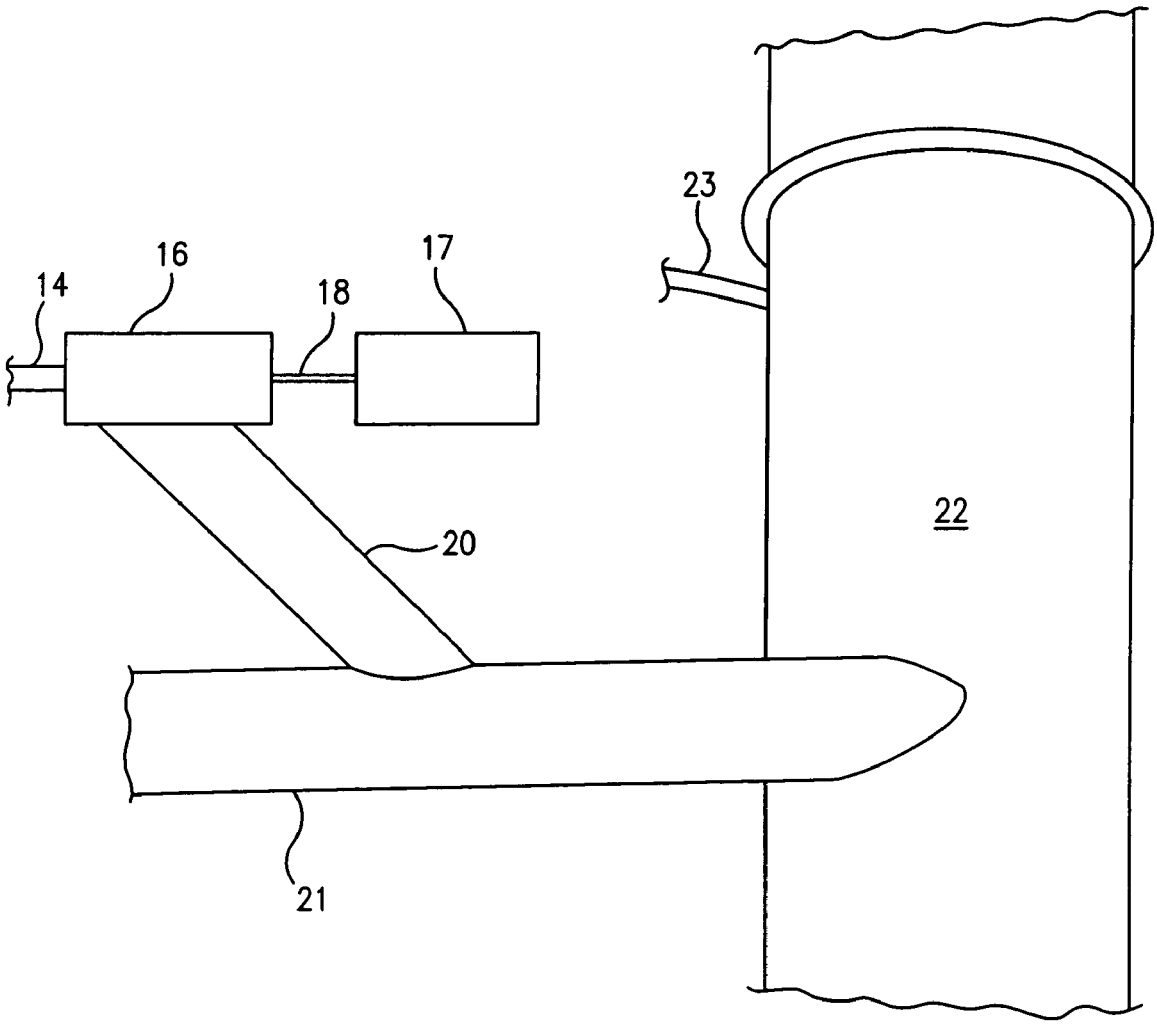
FIG. 3 shows a fragmentary representative elevation view of a feed pipe which feeds the fiberglass and binder tangentially into a cyclone mixer as in the embodiments of FIG. 1.

Still referring to FIG. 3, the chopped fiber is picked up by air flow in a pipe 20 which feeds into a flow of air in pipe 21, the flow of air in pipe 20 being provided by a blower (not shown). The pipe 21 feeds a first stream of the mixture of air and fiber tangentially into cyclone mixer 22.

Simultaneously, a second blower feeds a second stream of powdered phenolic binder into the cyclone, above the first fiber/air stream, at inlet tube 23.

Cyclones are generally used to separate particulate matter from an air stream by taking advantage of differential air velocities flowing circumferentially in the cyclone. In general, a cyclone has no moving parts which participate in the air entrainment and/or separation steps. In the invention, the cyclone is used to bring together the first and second air streams, thereby to mix the entrained particles of binder with the entrained strands of fiber, wherein the binder particles attach to the fiber strands, and to then separate the mixing air from the entrained mixture of binder particles and fiber strands whereby the mixer accomplishes the bringing together of the fiberglass strands and the binder particles while using no moving mixer parts in the mixing process.

The separate feeds of binder and fiberglass thus become generally uniformly mixed, into a fiber-binder mixture-charge, by the air flowing through the cyclone and the so-created mixture is temporarily held in the cyclone mixer by the entraining air which is passing through the cyclone mixer, while the process of mixing the fiber and binder with each other, and preliminary attachment of the binder to the fibers, is taking place.

Figure 4:
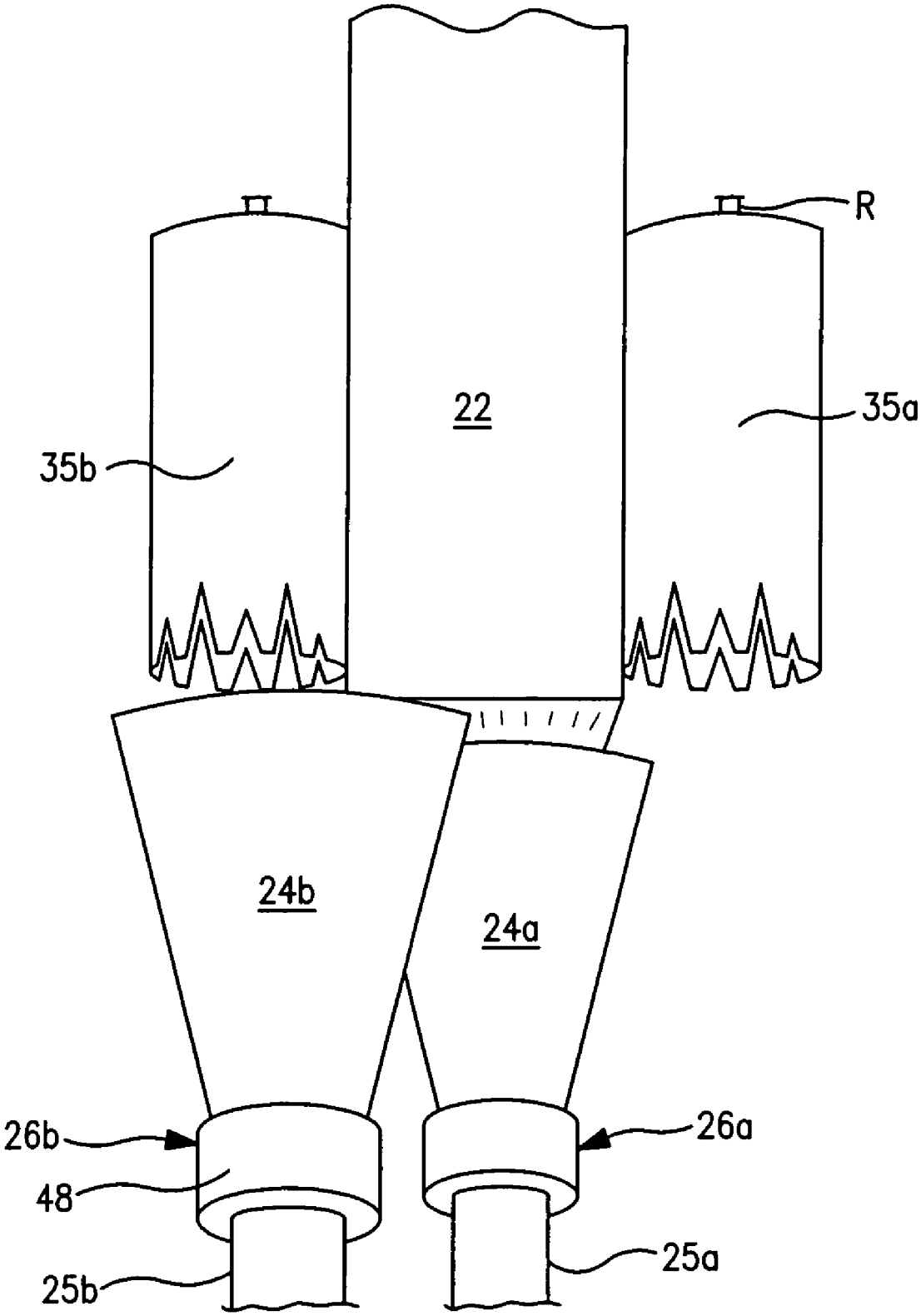
FIG. 4 shows a fragmentary representative elevation view as in FIG. 1, focusing closer attention on the cyclone mixer, the funnels, and the tampers.
Figure 7:
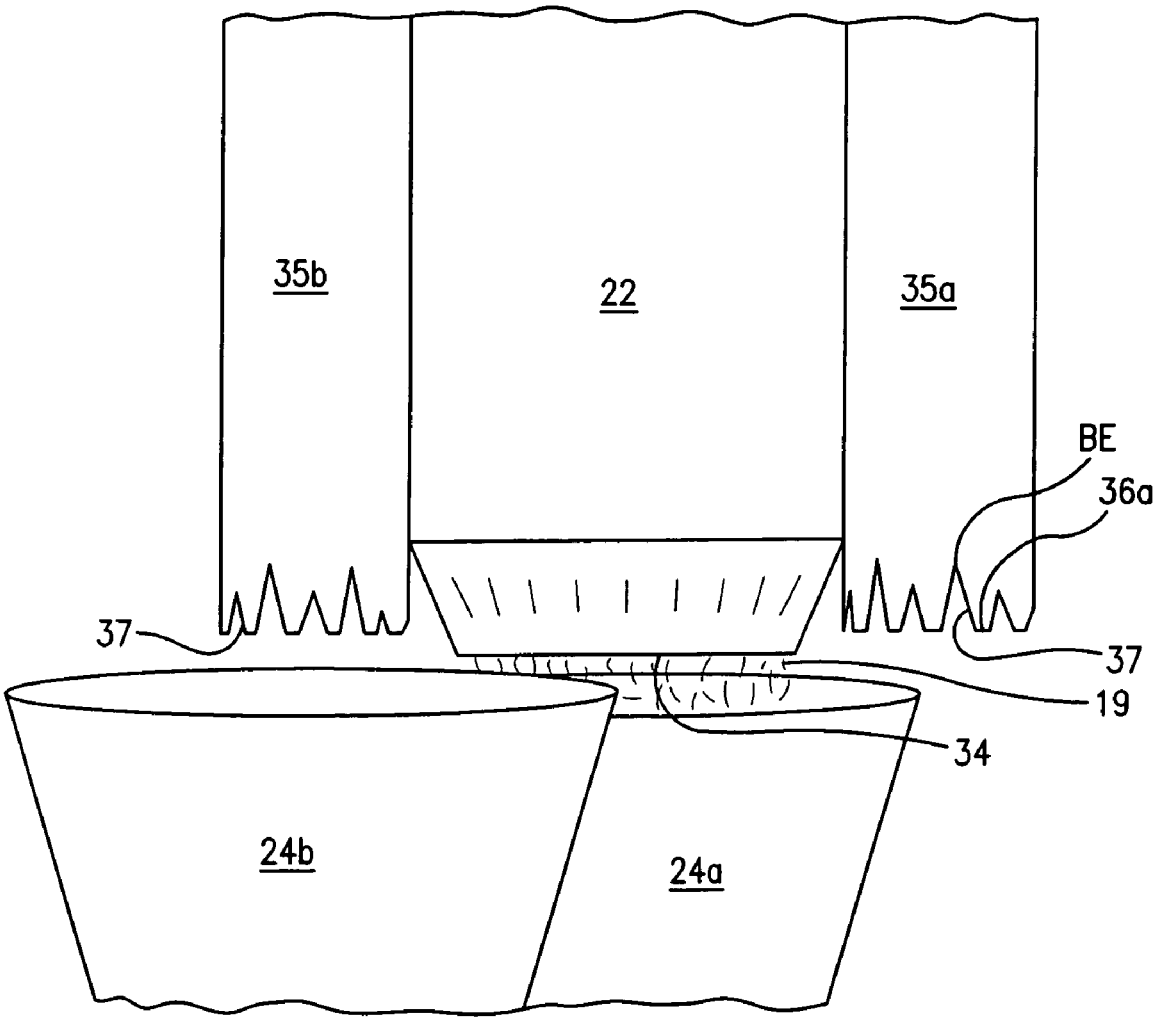
FIG. 7 shows an enlarged fragmentary view of upper portions of the funnels and lower portions of the tampers and the cyclone mixer, and illustrates the fiberglass-binder mixture dropping from the cyclone mixer into one of the funnels.

Referring now to FIGS. 1, 4 and 7, after a short mixing time in the cyclone, air flow to the cyclone is shut off, whereupon the previously air-entrained mixture charge 19 of chopped fiberglass and binder free falls by gravity out the bottom of the cyclone, through open space, and into a funnel 24*a* which is aligned with the open, lower end of the cyclone.

Referring to FIGS. 1 and 4, funnels 24*a* and 24*b* are mounted over the tops of two corresponding molds 25*a*, 25*b*, using collar adapters 26*a*, 26*b*.

Figure 6:
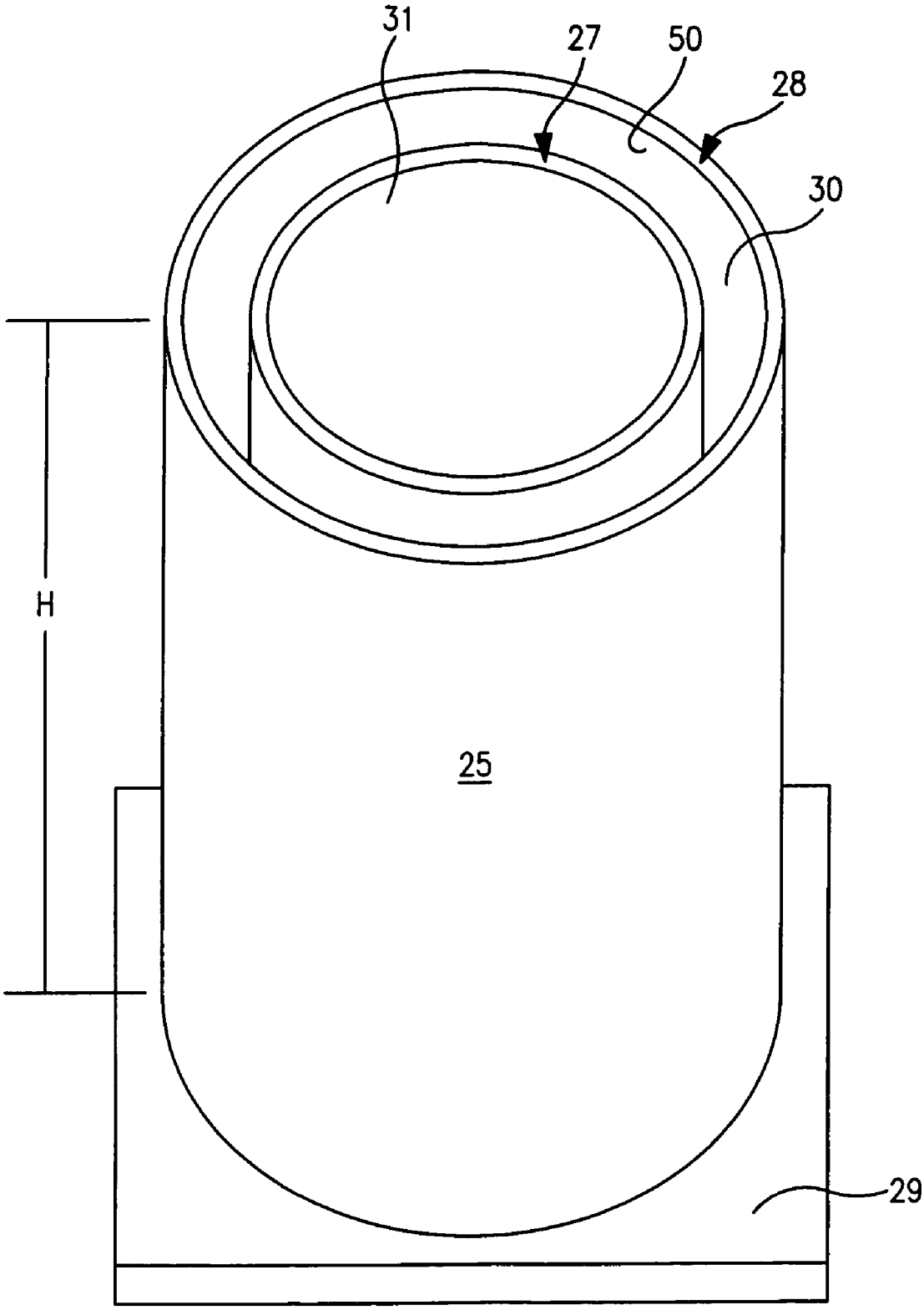
FIG. 6 shows a pictorial top view of an exemplary mold used in the invention.

An illustrative cylindrical mold 25 is shown in FIG. 6. Mold 25 has a top, a bottom, and a height "H" between the top and the bottom. An inner cylinder wall 27 of the mold is concentric with an outer cylinder wall 28. Both cylinder walls 27, 28 are mounted to base plate 29 which extends across the bottom of the mold and thus closes off the bottom of the mold and prevents flow of air along a generally single-direction path through the mold such as into the mold at the top and out of the mold at the bottom. A cylindrical fiber-receiving cavity 30 extends from the bottom of the mold to the top of the mold, between cylinder walls 27, 28. A central cavity 31, which does not receive fiber, is enclosed by inner cylinder wall 27.

Figure 5:
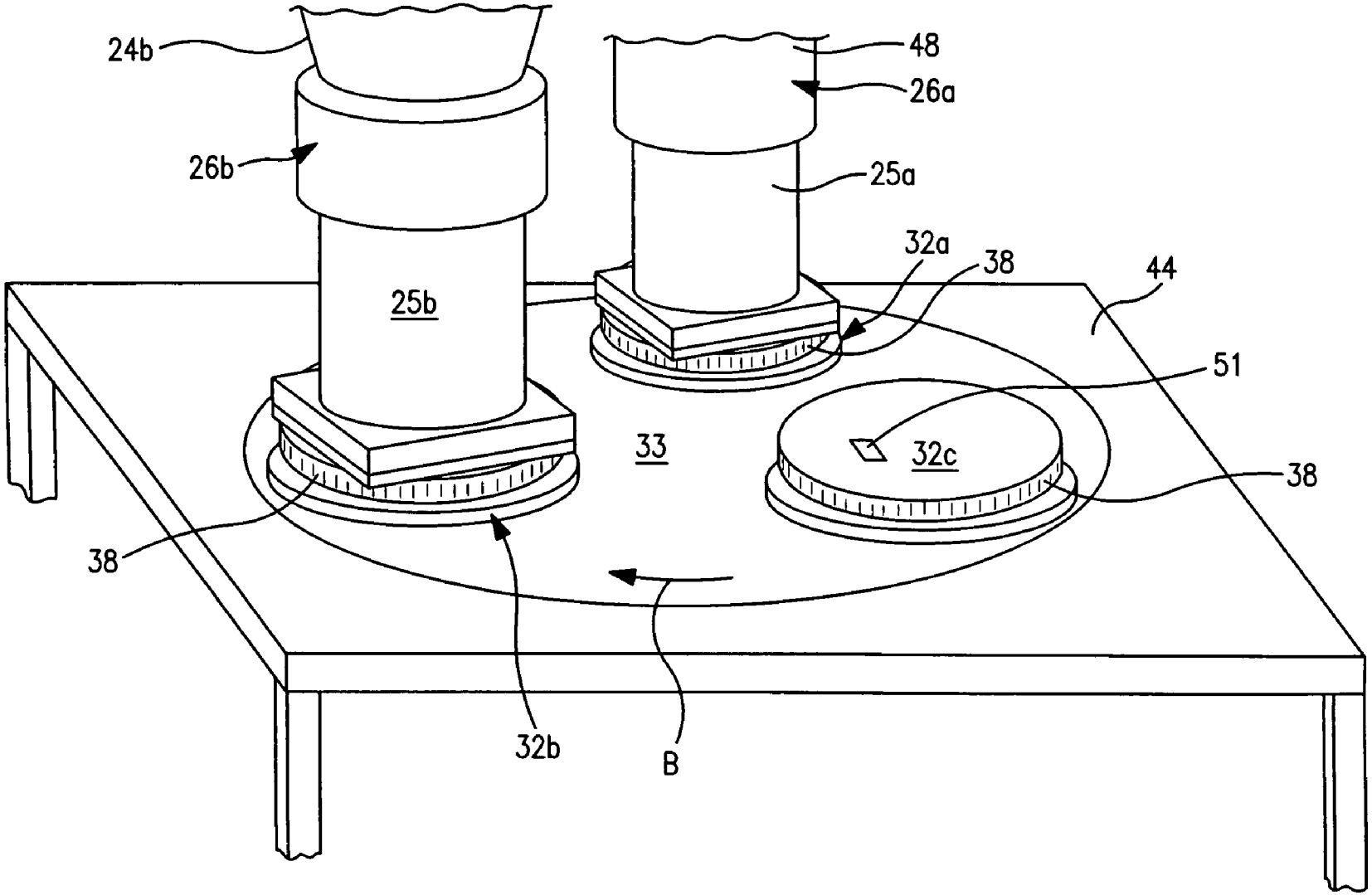
FIG. 5 shows a fragmentary representative pictorial view of two of the molds, the rotating jigs which support the molds, and the mold rotating tables.

Referring to FIGS. 1, 5, and 7, molds 25*a*, 25*b* are mounted on rotating jigs 32*a*, 32*b* by mounting apparatus (not shown). Jigs 32*a*, 32*b* are mounted on turntable 33 such that the tops of the funnels are generally below the bottom edge 34 of the cyclone. Turntable 33 is mounted on stationary table 44 or other supporting structure. A third mold can be mounted on the third jig 32*c*, and a third funnel can be mounted over the top of the third mold using a third collar adapter. Thus, the illustrated apparatus provides for 3 mold set-ups, each mold set-up including a jig 32, a mold 25, and a funnel 24. All three of the mold set-ups desirably are operational while the machine 10 is being used to fill molds 25.

Referring to FIG. 1, as well as to FIGS. 5 and 7 as illustrated, the three rotating jigs 32 are located on turntable 33 and turntable 33 is oriented/rotated such that the jig 32*a* which holds funnel 24*a*, and its corresponding mold 25*a*, is positioned farthest away from the viewer and is aligned with the longitudinal axis "A" of the cyclone. The remaining two jigs 32*b*, 32*c* are positioned equidistant about turntable 33 and are thus closer to the viewer than jig 32*a*. First and second tampers 35*a*, 35*b* are also positioned equidistant from cyclone 22 such that tampers 35*a*, 35*b* are positioned in axial alignment over jigs 32*b*, 32*c* when jig 32*a* is positioned under the cyclone. Each tamper, at its operating end, is a hollow tube as seen in e.g. FIG. 4. The leading edges 36 of the tampers have teeth 37.

Figure 8:
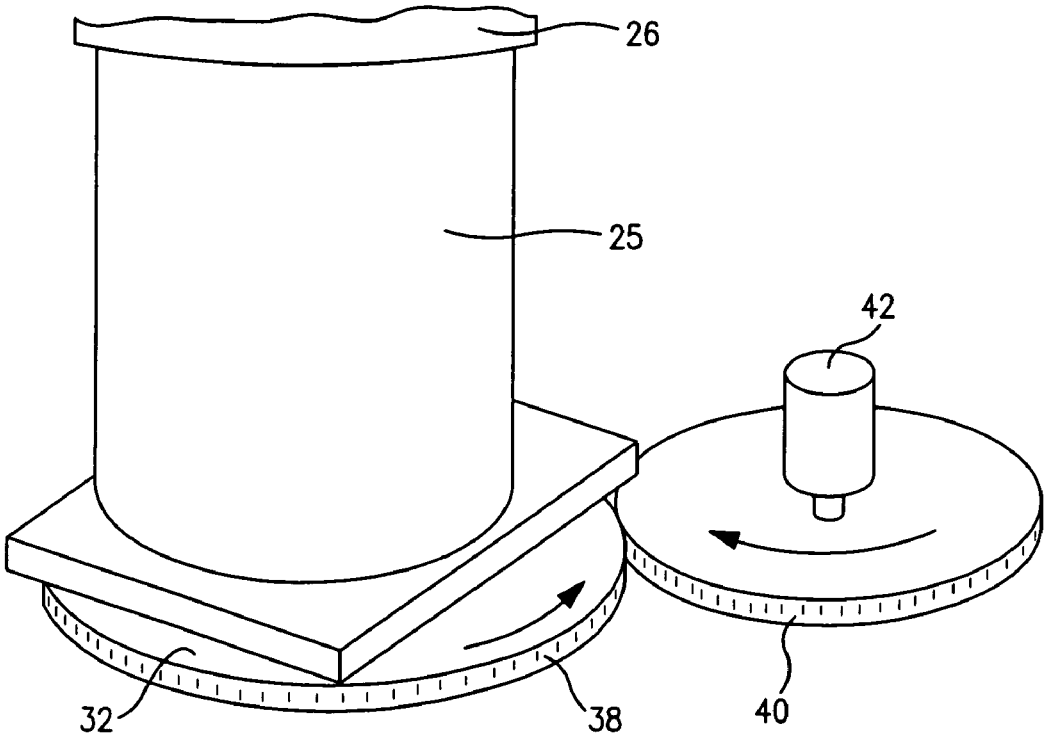
FIG. 8 shows a first gear on a mold rotating table being turned by a second drive gear at the index locus where the funnel overlying the mold is positioned to receive the fiberglass-binder mixture from the mixer, whereby the funnel and mold can be rotated while the fiberglass-binder mixture is being dropped into the funnel and mold.

Referring to FIGS. 5 and 8, each jig 32 is mounted for rotation with respect to turntable 33 and includes a toothed gear 38 which rotates about a vertical axis and correspondingly accommodates rotation of the entirety of the jig. When the respective jig and its associated mold and funnel come into alignment with cyclone 22, the respective gear 38 comes into engagement with a second toothed gear 40. Motor 42, and correspondingly gear 40, are fixedly mounted to stationary table 44. Gear 40 is driven by motor 42 when cyclone 22 is being emptied of its mixture of fiberglass and binder.

If and as desired, motor 42 and gear 40 can be movably mounted to table 44 such that gear 40 and motor 42 move away from gear 38 when gears 38, 40 are not to be engaged.

The rotation of gear 40 operates as a driver to thus drive gear 38, causing rotation of gear 38, which rotates the corresponding jig 32, the overlying mold 25, and the corresponding overlying funnel 24. Gear 40 thus operates as a drive gear while gear 38 operates as a driven gear.

To the extent the fiberglass-binder mixture may be distributed unevenly about the circumference of the cyclone before the mixture is dropped from the cyclone into the funnel, the rotation of the respective funnel 24 and mold 25, by gears 38, 40, tends to more uniformly spread the fiber-binder mixture about the circumference of the funnel thus attenuating, in the funnel, the affect of any such unevenness of distribution of the mixture in the mixer.

Such greater uniformity of distribution of the fiber-binder mixture about the circumference of the funnel translates to correspondingly greater uniformity of distribution of the mixture in the mold after the mixture has been transferred from the funnel into the mold.

In some instances, e.g. where the mold cavity 30, which receives the fiberglass-binder mixture, has a cross-section which varies about the circumference of the mold, the mold can be held stationary while a first charge of the fiberglass-binder mixture is being dropped through the funnel and into a first portion of mold cavity 30. The mold is subsequently rotated by gears 38, 40, and is again held stationary while a second charge of the fiberglass-binder mixture is dropped through the funnel and into a second different portion of the mold cavity. Second and subsequent charges of the mixture can be added at the first and second rotational states of the jig, as desired, such as to top off the quantity of mixture which has previously reached the mold which is being charged.

The mixture, as dropped into the funnel, has a relatively low density, and exhibits a fluffy characteristic, whereby less than all of the mixture drops through the funnel and directly into the underlying mold 2, especially where, as illustrated in FIG. 6, the cavity 30 has a relatively narrow cross-section. For example, in an exemplary mold 25, the cross-section of mold cavity 30, between walls 27, 28 is about 0.5 inch (13 mm).

After the mixture has been dropped into e.g. funnel 24*a*, turntable 33 rotates clockwise as indicated by arrow "B" in FIG. 5, bringing jig 32*b*, funnel 24*b*, and its associated mold 25*b* into alignment under cyclone 22, thereby bringing the teeth on driven gear 38 on jig 32*b* into engagement with the teeth on drive gear 40. Cyclone 22, and tampers 35*a* and 35*b* are otherwise supported over turntable 33 by other support structure, and thus do not rotate with turntable 33. The rotation of turntable 33, which brings funnel 24*b* into alignment with cyclone 22, also brings funnel 24*a*, and its associated mold 25*a*, into alignment with, and under, tamper 35*a*.

With the jigs, molds, and funnels in these vertically-arrayed, and rotated positions, chopper 16 again chops the requisite amount of fiber, and the newly-chopped fiber, along with the requisite amount of binder, are blown into cyclone 22, are mixed in cyclone 22, and are dropped from the mixer, into funnel 24*b* while funnel 24*b* and its associated mold are being rotated by gears 38, 40.

Coincident with the process of the cyclone mixer mixing the fiber and binder, and dropping the fiber-binder mixture into funnel 24*b* and mold 25*b*, tamper 35*a*, which is in alignment with the circular opening at cavity 30 in the underlying mold, and in axial alignment with funnel 24*a*, is driven downwardly by e.g. a hydraulic cylinder or a pneumatic cylinder, and corresponding ram "R", or a chain drive, driving the toothed leading edge 36*a* of tamper 35*a* into close proximity with the bottom of cavity 30 in the underlying mold. As tamper 35*a* descends through the funnel and downwardly into cavity 30, the leading edge 36*a* of tamper 35*a* engages a portion of the fiberglass-binder mixture which is in the funnel and drives that associated portion of the mixture ahead of the leading edge of the tamper and downwardly into cavity 30. Tamper 35*a* then withdraws from the mold and the funnel, to the position shown in FIGS. 4 and 7.

In routine operation of the mold filling machinery 10, a third mold/funnel combination (not shown) is mounted on the third jig which, at this stage of the process, is in the position which had been occupied by funnel 24*b* in FIGS. 4 and 7. Thus, when the machine is in operation, 3 molds and 3 funnels occupy the respective 3 jigs on turntable 33.

After funnel 24*b* has received the requisite charge of fiber-binder mixture, with corresponding rotation of the jig/mold/funnel combination according to gears 38, 40, turntable 33 again rotates, moving all three jigs/molds/funnel combinations, to bring the third jig/mold/funnel combination into alignment under the cyclone mixer. The second jig/mold/funnel combination is under tamper 35*a*. The first jig/mold/funnel combination is under tamper 35*b*. At this point, tamper 35*a* again descends to approximately the bottom of mold cavity 30 under funnel 24*b* and withdraws, and tamper 35*b* descends to approximately the halfway point, mid-point, of the height of mold 25*a* under funnel 24*a*. Thus, the tamping strokes by tamper 35*a* descend to close proximity to the bottom of the mold cavity, generally moving the fiber-binder mixture to a relatively lower portion of the mold while the tamping strokes by tamper 35*b* descend only to the midpoint of the height of the mold cavity which is under the respective funnel, generally moving the fiber-binder mixture into a relatively upper portion of the mold. At this stage of the filling process each tamping stroke of each tamper is a single longitudinal movement of the tamper, driving the leading edge of the respective tamper down into the mold cavity, and subsequently back up above the top of the corresponding funnel.

According to the process described so far, a measured quantity/charge of the fiberglass-binder mixture is dropped into each of the three funnels as each respective funnel comes into alignment under cyclone 22. When the respective funnels are, after indexing, under tamper 35*a*, a single stroke of the tamper descends to close proximity to the bottom of cavity 30 in the underlying mold 25, depositing a first portion of the mixture in the lower portion of the mold. When a respective funnel is, after again indexing of turntable 33, under tamper 35*b* after this first deposit of the fiber/binder mixture into the funnel, a single stroke of tamper 35*b* descends to about the mid-point of the height of the mold cavity and then retracts, depositing a second portion of the mixture in the upper portion of the mold.

After all three molds have received a first measured charge of the mixture, each jig/mold/funnel combination is carried, by the rotation of turntable 33, so as to sequentially reside under cyclone 22 a second time, receiving a second deposit of the fiber-binder mixture from cyclone mixer 22. However, in this second rotation, tamper 35*a* does not act on the mixture in the funnel. Rather, when the respective funnel and mold are being rotated under tamper 35*b*, tamper 35*b* makes two down strokes and two withdrawals, both strokes reaching to about the midpoint of the height of cavity 30 in the underlying mold.

Thus, the leading edge of the first deposit of fiber-binder mixture is driven generally lower in the mold cavity by tamper 35*a*, with a follow-up mid-point tamp by tamper 35*b*; while the leading edge of the second deposit of fiber-binder mixture is driven to the midpoint of the mold height only, by tamper 35*b* albeit by two such tamping strokes.

Figure 9:
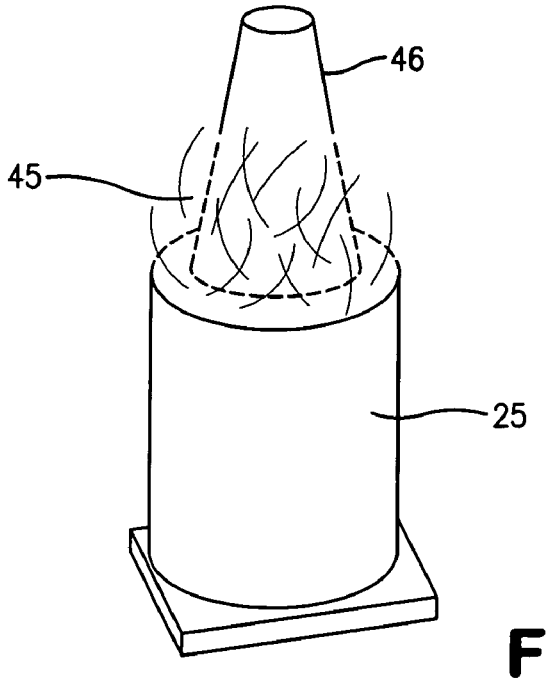
FIG. 9 is a pictorial view showing the mold, still bearing a mold plug, after the mold has received a charge of the respective fiberglass-binder mixture, and the mixture has been tamped by the tampers, and after the funnel and the collar adapter have been removed.

Upon completion of the second filling and the second tamping of each of the three molds, the molds are removed from turntable 33. The respective funnels 24 and collar adapters 26 are removed from the tops of the molds, leaving the filled molds looking substantially as illustrated in FIG. 9. As seen in FIG. 9, the matrix 45 of fiberglass extends above the top of the mold, illustrating that tampers 35*a*, 35*b* have moved less than all of the fiberglass-binder mixture into mold cavity 30. Each mold also has a cone-shaped plug 46 mounted over the top of cavity 31 (FIG. 9) in mold 25. Cone-shaped plug 46 has a cylindrical extension minimally smaller than the cross-section of central cavity 31, and smaller than the bottom of the conically-shaped upper portion of the plug, whereby the extension extends into cavity 31, closing off cavity 31 so the fiber-binder mixture does not fall into cavity 31, while a transition zone of the plug 46 interfaces with the top of wall 27. Plug 46, at its greatest cross-section, generally matches the outer circumference of inner cylinder wall 27, and tapers conically inwardly and upwardly to the top of plug 46. Thus, the illustrated plug 46 provides a generally continuous tapered surface which guides the fiberglass-binder mixture downwardly toward cavity 30, and makes a smooth transition for traverse by the mixture from the widest cross-section of the plug into cavity 30. A flat cap/lid can be used in place of cone 46, if and as desired, to keep the mixture from falling into opening 31.

Collar adapters 26 likewise provide a smooth interface between funnels 25 and cylindrical cavities 30. As illustrated in the drawings, a collar adapter 26 has a generally cylindrical configuration wherein an outer wall surface 48 of the collar adapter has a diameter greater than the diameter of both the bottom of the funnel and the top of cylinder wall 28. The inner surface of the collar adapter forms an unobstructed, optionally smooth, transition for the mixture transitioning between the inner surface of the bottom of the funnel and the inner surface 50 of outer cylinder wall 28 in the mold. Collar adapter 26 also provides a recessed bottom seat which receives the top of outer cylinder wall 28, and a recessed top seat which receives the bottom of funnel 24. Similar seat adaptations can be made on the mold and funnel instead of, or in addition to, adaptations on the collar adapter.

All operations of mold filling machinery 10 can be controlled by a suitable programmable logic computer (PLC) accessed through a suitable user interface designated as 52 in FIG. 1.

The quantity of fiber-resin mixture delivered to the cyclone in a given step is referred to herein as a "charge". In preferred embodiments herein illustrated, the process of filling a given mold with fiber-resin mixture includes delivering two charges of the mixture to the cyclone, and thus to the mold, although a single charge, and three or more charges, is within the scope of the invention.

One way of measuring the quantity of fiber and resin delivered to the cyclone is by measuring mass flow rate. Using mass flow rate procedures, the weight of fiber in a given charge mixture is controlled by controlling the number of revolutions of the chopper motor; and the weight of resin in a given charge mixture is controlled by controlling the number of revolutions of the resin feed motor.

As part of the process of determining the number of revolutions of the chopper motor, an average weight per length of fiber rope is determined, whereby the desired mass of the rope to be fed to mixer 22 can be expressed in terms of the length of the rope, and any length of the rope can be expressed in terms of the number of drive revolutions of the chopper motor. The length of fiber which is fed through the chopper per revolution of the motor is determined off line, thus establishing a base line feed rate of fiber per revolution of the chopper motor. Based on that preliminary information, the weight of that fiber rope which is fed and chopped per revolution of the motor is known, whereby the number of revolutions required to deliver a desired weight of chopped fiber to the cyclone can be calculated. Once the weight per revolution is known, the feed rate per revolution is known, and the number of revolutions of the chopper motor, required to deliver a specified mass of the fiber to the cyclone for a given feed cycle can be specified.

As part of the process of determining the number of revolutions of the resin feed motor, the quantity of resin fed per revolution of the resin feed motor can be determined off line, whereby the number of revolutions per feed cycle to the cyclone can be calculated, and then specified, for the resin feed motor.

By so using the number of revolutions of the respective motors feeding the resin and fiber to the cyclone, the quantities of the fiber and resin provided to the cyclone, for any given charging of the resin and fiber mixture to the cyclone, can be individually controlled.

Using this method of determining base-line material quantities assumes that the predicted quantity of both fiber and resin, based on trial quantities established off-line, are delivered both to the cyclone and to the mold with sufficient precision to satisfy the repeatability requirements of the insert core product. So long as the fiber and resin raw material feeds maintain consistent properties, and the respective motors deliver consistent performance, the material mass flow rates can be predictably relatively constant; though the material feed rates may be periodically re-calibrated off line. If any specification of either binder raw material or fiber raw material changes, such as the number or thickness of fiber strands in a rope, or size distribution or surface properties of the resin, then the respective fiber chopper motor or resin feed motor can be re-calibrated to determine the new feed rate per revolution for that motor.

Where the first charge is intended to be placed generally in the lower portion of the mold and the second charge is intended to be placed generally in the upper portion of the mold, each of the first and second charges may contain more or less 50% of the total mass of fiber-resin mixture to be added to the mold.

Another way of measuring the quantity of fiber and resin is by using such off-line trials to establish initial targets for the number of revolutions for each of the fiber chopper motor and the resin feed motor, thus establishing initial feed rate motor revolution specifications, then weighing the molds to determine the actual total amount of the mixture which is added, and using such weights in a closed feed-back loop which feeds the mold add-on weights to the controlling PLC. The PLC then adjusts the number of revolutions of the fiber chopper motor and/or the resin feed motor, which are used for creating subsequent charges of the fiber-resin mixture in the cyclone, based on the add-on weight data actually collected.

Where two charges of the fiber-binder mixture are used for filling a given mold, before depositing the first charge of the fiberglass-binder mixture, initial feed rate targets are established for both the fiber chopper motor and the resin feed motor. Separately, the combined mold set-up, including mold, jig, collar adapter, plug, and funnel are weighed at a weigh station, for example a load cell 51 on the jig to establish a tare weight. After depositing the first charge of fiberglass-binder mixture in a respective mold, the mold set-up is again weighed so as to determine the amount of the mixture, namely fiber plus binder, which has already been added to the mold set-up. The add-on weight is then compared to a target weight, and the quantity of the second charge of fiberglass and binder is then computed. The computed second charge amount is converted to motor revolutions for the chopper motor, and separately, motor revolutions for the resin feed motor, based on a previously established fiber/resin weight ratio, and the chopper motor and resin motor are instructed accordingly, causing the second charge amount to be fed to the cyclone.

Thus, prior to receiving the first charge, the load cell can be used to record the tare weight of the given mold set-up which includes the weights of mold 25, collar adapter 26, plug 46, and funnel 24. The tare weight is sent to the PLC or other memory device where the tare weight is stored. After the first charge has been received and tamped, the load cell records a second weight, which now includes the fiber-binder charge add-on and sends the second weight to memory. The PLC compares the first and second weights and computes the mass of the charge added, and compares that charge added weight to the desired total weight of the insert core. The PLC then computes/calculates the desired amount of the second charge and sends corresponding instructions to the chopper motor and to the binder feed motor.

By so using first and second charges, and providing the majority of the mixture mass in the first charge, such as 70%, 80%, 90% by weight in the first charge, the amount of the second charge can be substantially less than that of the first charge, whereby the prospective variance in the second charge can be less than that of the first charge, resulting in a substantially lower overall variance in the weight of the finished core than is achieved by using a single charge of the mixture.

By using tare weight, first charge weight, and second charge weight on each mold/funnel/jig combination, the actual mass in a given mold at the end of the filling process, can be closely controlled.

In addition, the PLC can be programmed to calculate a trailing final variance over the last 10, 20, 50, 100, 500, 1000 etc iterations of mold filling, and to use such data to optimize the amount of the first charge, and correspondingly the amount of the second charge, according to the histories of those mold iterations which most closely approached the targeted final mass of the mixture in the respective molds. In the alternative, the PLC can be programmed to determine other measures of variance and variance control in order to closely control variance of add-on mass in the mold-filling operation.

In tamping the charge mixture into a mold, that portion of the mixture which is engaged by the leading edge of a tooth is delivered to the vicinity of the bottom of cavity 30. That portion of the mixture which is engaged by the sides of the teeth is delivered to depths above the bottom of the cavity. By using teeth which have more than one depth of the cut at the terminal blind end "BE" of the groove between the teeth, as illustrated in the drawings, the different groove depths deliver different portions of the mixture to different depths in cavity 30. Thus, the teeth in the tampers provide for vertical distribution of the mixture in cavity 30, while rotation of jig 32 during discharge of the mixture from the cyclone mixer 22 provides for circumferential distribution of the mixture in cavity 30. The process thus provides improvements in both vertical and circumferential distribution of the mixture in cavity 30.

Once the molds are removed from turntable 33, a second set of 3 molds is placed in jigs 32; cone-shaped plugs 46 are placed on the newly-placed molds; collar adapters 26 are placed on the newly-placed molds; funnels 28 are placed on the newly-mounted collar adapters; and the mold filling process is repeated.

While the second set of 3 molds is being filled, including being tamped, the matrix 45 of fiberglass which extends above the top of the already-filled molds, as illustrated in FIG. 9, is tamped down into the respective mold cavity 30, using e.g. a suitable tool. A cap (not shown) is then placed on the top of the mold and the filled mold is passed through an oven which exposes the closed mold to about 600 degrees F. heat for about 15 minutes; specifically enough time to set the binder without driving off, e.g. evaporating, the binder, or burning the binder.

The setting/curing of the binder stabilizes the collective configurations of the fiberglass strands in the so-configured cylindrical configuration of cavity 30, such that the resulting muffler insert core is shape-constant, shape-stable whereby the resulting cured/set fiberglass-binder core 54 can be manually handled without necessarily jeopardizing the shape/configuration of the cured product. It is this stabilizing of the fiberglass product, in combination with uniform distribution of the fiberglass in the product, which is critical to being able to ensure that the fiberglass will fill substantially the entirety of the cavity in the muffler when the binder burns off under the influence of exhaust gases from the vehicle engine.

After curing of the binder by exposing the molds to the e.g. 600 degrees F., the so heated molds are allowed to cool to working temperature such that the molds can be handled safely without risk of a worker being burned. The resultant insert core is then removed from the mold using e.g. a suitably-configured plunger (not shown). Where a clamshell mold (not shown) is used, the resultant insert core can be removed from the mold by simply opening the clamshell and manipulating that portion of the core which extends from the mold.

The resulting shape-constant insert core product may have residual fiberglass strands extending from e.g. the top of the core, the top of the core being defined consistent with the top of the mold. Once the cured core 54 has been removed from the mold, any such excess fiberglass material, now stiffened by the cured binder, can be removed using a cut-off saw. The cut-off process can also be used to trim the product to the specified length, if necessary.

Once the excess material has been cut off, including conforming the product to the specified length, the resulting cured fiberglass-binder product core 54 generally represents the size, shape, and the overall configuration of the fiberglass-based insert product which is desired, for insertion into a cavity inside a muffler shell.

In the illustrated embodiment, a bore 56 extends entirely through the core, from a first end 58*a* to a second end 58*b*, thus defining apertures 60 at opposing ends of the core.

In other embodiments, a bore can extend, from a location on the outer surface of the core, inwardly into the core, and terminate at a dead end inside the core.

In still other embodiments, multiple bores can extend either into the core to dead ends, or entirely through the core. Further, in a given core, one or more bores can extend entirely through the core while one or more other bores extend into, but not through, the core.

Whatever the nature and/or structure of the cured, shape-constant core, the next stage in fabrication of the insert is to shrink wrap the core in plastic film. A wide variety of single and multiple layer shrink films are suitable for such shrink wrapping. The intended function of the shrink film is generally to temporarily package the core until the insert is assembled into a muffler shell. Thus, the finished insert is subjected to only limited handling before the role of the shrink film has been completely satisfied. Accordingly, the shrink film can be selected from films which have limited abuse tolerances, which generally applies to films which are relatively lower in cost.

In general a polyethylene shrink film, one mil thick, is suitable for use as the shrink wrapping film.

Figure 10:
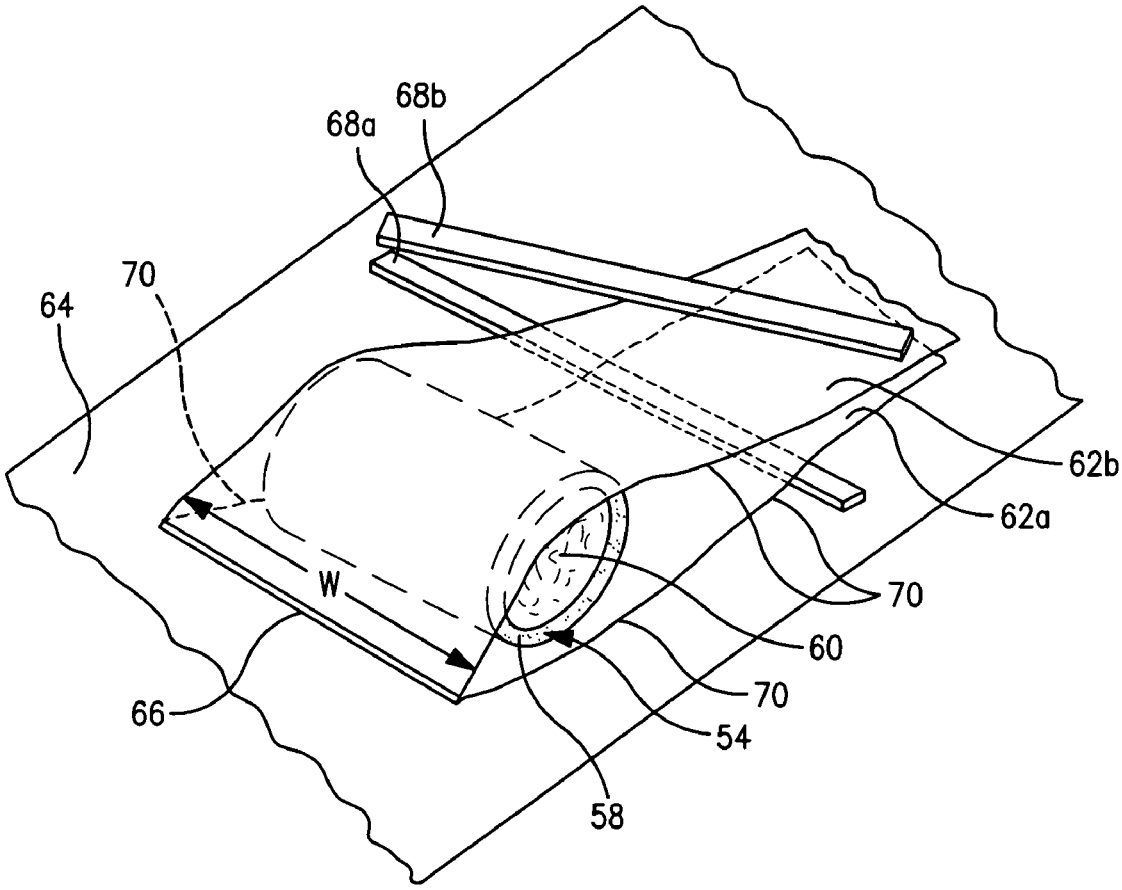
FIG. 10 is a pictorial view of an insert core after the core has been cured, removed from the mold, and trimmed for length, and wherein the core is positioned between two films, ready for the film to be heat sealed and shrunk about the core thus to finish fabrication of the muffler insert.

As illustrated in FIG. 10, at this stage of the fabrication process, the shape-constant cured fiberglass-binder core is placed between first and second films 62*a*, 62*b* on a heat seal table 64. Films 62*a* and 62*b* have generally the same widths, with the edges of the films generally aligned with each other. Film 62*b* generally overlies film 62*a*. As shown, the leading edges of the two films are already heat sealed to each other at heat seal 66 which extends across the widths "W" of the films, thus providing a closed leading edge of what will become the generally-enclosing shrunk film.

Transverse seal bars 68*a*, 68*b* extend across heat seal table 64. Bar 68*a* is generally fixed at the height of the table. Bar 68*b* is suspended above table 64 and is articulated so as to be movable down into contact with bar 68*a* when a heat seal is to be made.

As shown in FIG. 10, the fiberglass-binder core is placed between films 62*a* and 62*b*. Films 62*a* and 62*b* are between seal bars 68*a* and 68*b*. The core is positioned generally equidistant between the side edges 70 of a given one of the films, with the apertures 60 in the core facing toward the side edges of the films. The core and the film, collectively, are positioned close to transverse seal bar 68*a* on the table, with excess film drawn toward and through seal bar 68*a*.

With the core and film so positioned, heat seal bar 68*b* is heat activated and is articulated downwardly into contact with the film and urges the film against seal bar 68*a*, thus trapping the film between seal bars 68*a* and 68*b* and forming a trailing heat seal on the opposing side of the core from leading heat seal 66, and correspondingly cutting the so-sealed film from the film webs 62*a*, 62*b* being fed to table 64.

At the conclusion of the heat sealing/cutting process, the sealed film has been severed from the remaining portions of continuous films 62*a*, 62*b*, and the severed portions of the films have generally enclosed the core, with the open side edges 70 of the films aligned with apertures 60 in the core. Correspondingly, the heat seal just created has left a subsequent sealed leading edge on the remainder portions of films 62*a*, 62*b*, thus leaving the leading edges of films 62*a*, 62*b* in the condition shown in FIG. 10, ready to receive the next core.

The cut-off product is then a stand-alone product, with the core loosely enclosed in a shrinkable film and wherein the film is open at the sides of the product and the sides of the film are aligned with apertures 60. The core-film combination is then passed through a shrink chamber where the film is heated and thereby shrunk about the core to produce the finished shrink wrapped insert product 72, illustrated in FIG. 11.

In shrinking, the films shrink both in the longitudinal direction along what was the lengths of the films, as well in the transverse direction, across what was the widths of the films. Accordingly, the longitudinal shrinkage of the films draws the films tight about the outer circumference of the core. The transverse shrinkage of the films draws what was the side edges of the films against the ends 58 of the core such that the side edges 70 of the films are drawn into contact with the core in close proximity with apertures 60.

The width "W" of the film, prior to shrinking, is selected such that, with the core positioned generally centered on the widths of the films, transverse shrinkage of the films leaves the side edges 70 of the films generally coincident with the circumferences of apertures 60.

Thus, as the product exits the shrink chamber, the outer circumference of the cylindrically-shaped fiberglass core is entirely encased in the collectively shrunk film 74, and the film extends onto the ends 58 of the core, but does not extend entirely across apertures 60. In the embodiment illustrated in FIG. 11, the edge of the shrink film extends generally to, but not across, apertures 60, thus leaving a small portion 76 of the end of the core, shown as stippled in FIGS. 11 and 12, not covered by the shrunk film.

The resulting product is generally rigid, though somewhat pliable so as to be able conform to slight irregularities in the inlet exhaust pipe coming from the engine, or slight irregularities in the inner surface of the outer shell of the muffler. The plastic film surrounds the outer circumference of the contained fiber-binder core and generally wraps around the ends of the core, so as to present generally smooth plastic surfaces to the inner surface of the muffler shell, as well as to any end plates or transition portions of the muffler shell.

Figure 11:
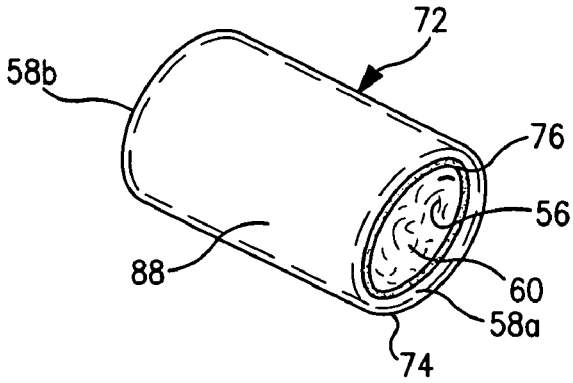
FIG. 11 is a pictorial view of the insert core of FIG. 10 after the film has been heat sealed about the core, and the film has been shrunk about the core, thus finishing the fabrication of the insert.
Figure 12:
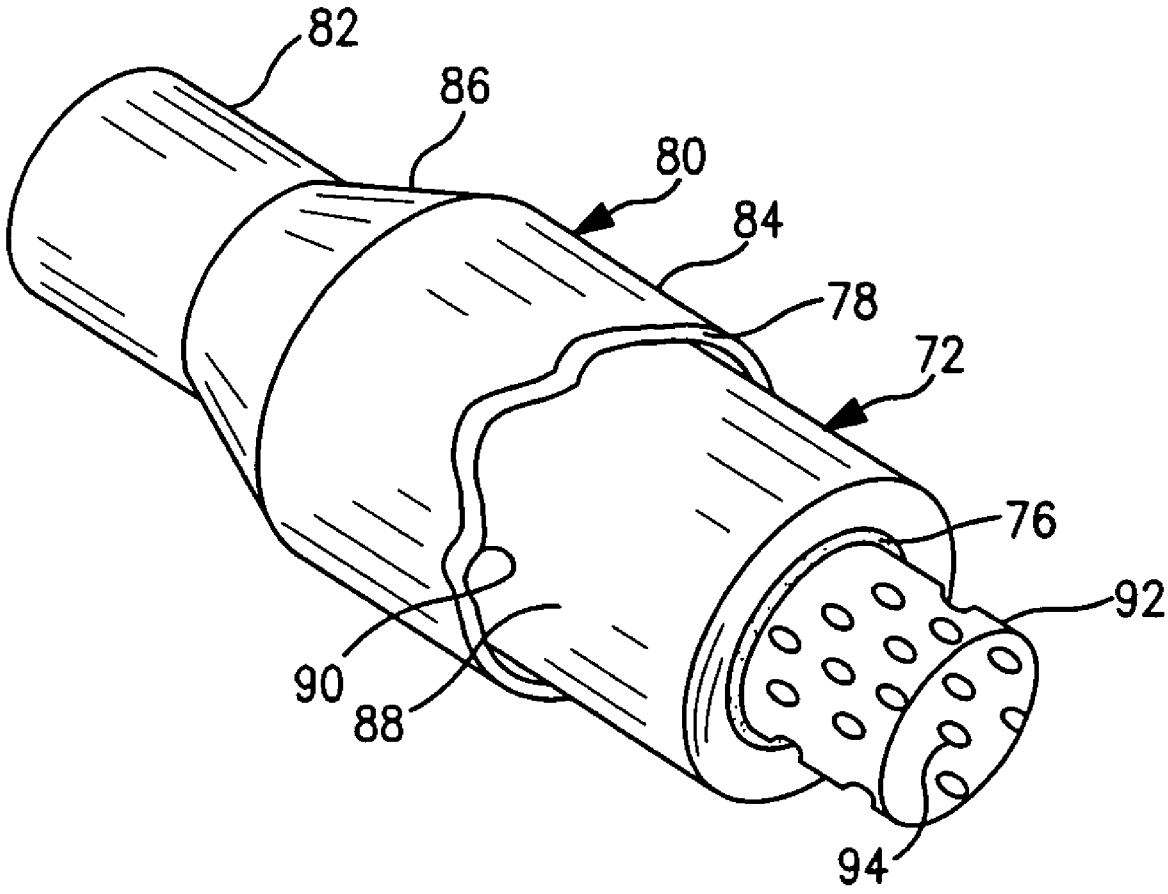
FIG. 12 is a pictorial view of a straight-through-flow muffler which incorporates the insert of FIG. 11.

FIG. 12 shows a cut-away illustration of the insert of FIG. 11 assembled into a muffler shell 78, thus forming the desired muffler 80 having the contained shrink-wrapped, fiberglass-based insert. Muffler shell 78 includes a lead-in section (not shown), an exit section 82, a relatively enlarged muffling section 84, a lead-in transition section (not shown) between the muffling section and the lead-in section, and an exit transition section 86 between the muffling section and the exit section. In general, the portions of the muffler shell represented by the lead-in section and the lead-in transition section are not assembled to the remaining portions of the muffler shell until after the insert has been assembled into the muffling section. FIG. 12 thus shows the exit section of the muffler shell, as well as the exit transition section and a portion of the muffling section. The lead-in section and the lead-in transition section are mirror images of the exit section and the exit transition section, respectively.

The outer circumference 88 of the finished, shrink-wrapped, insert product 72 generally conforms to the inner surface 90 of the muffling section of the muffler shell whereby the insert can be inserted into the muffling section by sliding the insert longitudinally into the muffling section.

In the embodiment illustrated in FIG. 12, exhaust inlet pipe 92 extends straight through the inlet section, through the inlet transition section, and through the muffling section of the shell. Inlet pipe 92 has apertures 94 which allow exhaust gases to exit the exhaust pipe and mingle with the fiberglass in insert 72, as well as allowing the shock waves in the exhaust gases to exit pipe 92 through apertures 94 which, combination, results in substantial sound-reducing affect of the muffler.

Inlet pipe 92 can be assembled to the shell after the insert has been assembled to the shell. In such instance, the inlet pipe is inserted longitudinally into the aperture 60 which faces toward the reader in FIG. 12. As the inlet pipe is inserted into aperture 60, the leading edge of pipe 92 engages any portion of the shrink film which extends into aperture 60, and pushes that film inwardly into the bore. As the film is pushed into the bore, the film stretches and moves toward the inner surface of the bore, such that a portion of the film may lie between the inner surface of the bore and the outer surface of pipe 92.

In the alternative, inlet pipe 92 can be first assembled to the lead-in section and lead-in transition sections of the muffler shell. The so-assembled combination can then be assembled to the remaining portions of the muffler after the insert is assembled into the shell, including sliding the inlet pipe longitudinally into the bore of the insert as discussed above. Any remaining joints in the muffler are then closed, thereby providing final closure of the closed muffler product.

As another alternative, the inlet pipe can be assembled to the shell, or attached to a leading end of the exit section or the exit transition section, followed by sliding the insert over the inlet pipe and into the muffler shell, followed by closing off the inlet end of the shell to thereby provide final closure of the closed muffler product.

While the invention has been illustrated using three molds on turntable 33, more or fewer molds can be used as desired, such as a single mold, two molds, 4 molds 5, molds, and the like, and table 33, including jigs 32, can be re-configured accordingly to accommodate such different number of molds to be placed thereon.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A method of charging a cavity in a mold with a fiberglass-binder mixture, the method comprising:

(a) making a mixture of fiberglass strand material and binder in a mixer;

(b) moving a charge of the fiberglass-binder mixture from the mixer into a conforming guide, wherein the mixture in the conforming guide has a relatively low density fluffy characteristic;

(c) as a first consolidating operation, driving a driver and engaging the low density fiberglass-binder mixture thereby and driving the driver, and at least a portion of the low density mixture, into the mold; and (d) withdrawing the driver from the mold.

2. A method as in claim 1, further comprising, while moving the charge of the mixture from the mixer into the conforming guide, rotating the entirety of the conforming guide, and optionally rotating the mold.

3. A method as in claim 1, the consolidating operation comprising moving the driver vertically with respect to the conforming guide and thereby distributing the mixture both vertically and laterally in the mold.

4. A method as in claim 1 wherein the conforming guide is a funnel, the funnel being displaced, across open space, from the mixer.

5. A molded fiberglass product made using a method as in claim 1.

6. A muffler assembly comprising a muffler insert made according to a method as in claim 1.

7. A method of charging a cavity in a mold with a fiberglass-binder mixture, the method comprising:

(a) making a mixture of fiberglass strand material and binder in a mixer;

(b) moving an initial charge of the fiberglass-binder mixture from the mixer into a conforming guide; and (c) as a first consolidating operation, driving a driver and thereby engaging the fiberglass-binder mixture and driving the driver, and at least a portion of the mixture, into the mold; and (d) prior to introducing a second charge of the mixture into the mold, executing a second consolidating operation on the same initial charge of the mixture, including driving a driver against the mixture a second time.

8. A method of fabricating a glass fiber strand material molded product comprising (a) charging a mold as in claim 7;

(b) curing the binder in the mold, thus binding the glass fiber strand material into a cohesive molded product having generally the shape of the mold cavity;

(c) removing the molded product from the mold; and (d) after removing the molded product from the mold, enclosing the molded product in a plastic shrink film and heat shrinking the film about an outwardly-facing surface of the molded fiberglass-binder product such that the film closely surrounds substantially the entirety of the outwardly-facing surface of the molded fiberglass-binder product.

9. A method as in claim 8 wherein the combination of the molded product, surrounded by the shrunk film, comprises a muffler insert.

10. A method as in claim 8 wherein the insert core has a bore extending therethrough, the bore having first and second opposing ends, the insert core thus having an inwardly-facing surface facing across the bore, the method further comprising providing for apertures in the shrunk film at ends of the bore.

11. A method as in claim 7, the mold cavity having a height, the fiberglass-binder mixture comprising a low-density mixture, wherein the second consolidating operation, on the same initial charge of the mixture, includes driving the driver into the mold, and stopping the driving of the driver at the midpoint of the height of the cavity.

12. A method as in claim 7 wherein the second consolidating operation moves at least a portion of the mixture material being engaged into a relatively upper portion of the mold.

13. A method as in claim 5 wherein the binder is a powdered binder material.

14. A method as in claim 7, the second consolidating operation moving the fiber-binder mixture to a relatively upper portion of the mold.

15. A molded fiberglass product made using a method as in claim 7.

16. A method of charging a cavity in a mold with a fiberglass-binder mixture, the method comprising:

(a) making a mixture of fiberglass strand material and binder in a mixer;

(b) moving a charge of the fiberglass-binder mixture from the mixer into a conforming guide; and (c) as a first consolidating operation, driving a driver axially and thereby engaging the fiberglass-binder mixture and driving at least a portion of the mixture into the mold;

(d) driving a driver into the mold, against the same charge of the fiberglass-binder mixture a second time, and (e) making a second charge of the fiberglass-binder mixture in the mixer, moving the second charge from the mixer into the conforming guide, and subsequently executing a third consolidating operation.

17. A method as in claim 16 wherein the binder is a powdered binder material.

18. A molded fiberglass product made using a method as in claim 16.

19. A method of charging a cavity in a mold with a fiberglass-binder mixture, the method comprising:

(a) making a mixture of fiberglass strand material and binder in a mixer;

(b) moving a charge of the fiberglass-binder mixture from the mixer into a conforming guide; and (c) as a first conforming operation, driving a driver through the conforming guide, and engaging the fiberglass-binder mixture and driving at least a portion of the mixture, into the mold, wherein the moving of the charge from the mixer into the conforming guide comprises dropping the mixture such that the mixture falls by gravity from the mixer, through open space, and into the conforming guide.

20. A molded fiberglass muffler insert made according to a method as in claim 19.

21. A muffler assembly comprising a muffler insert made according to a method as in claim 19.

22. A method of charging a cavity in a mold with a fiberglass-binder mixture, the method comprising:

(a) making a mixture of fiberglass strand material and binder in a mixer;

(b) moving a charge of the fiberglass-binder mixture from the mixer into a conforming guide; and (c) as a first tamping operation, driving a tamper into engagement with the fiberglass-binder mixture and driving at least a portion of the mixture, into the cavity in the mold, a plurality of teeth being disposed at the leading edge of the tamper, and wherein the teeth extend, in a direction of movement of the tamper, from the leading edge of the tamper, a distance corresponding to about 25 percent to about 75 percent of the height of the mold cavity.

23. A method as in claim 22 wherein the binder is a powdered binder material.

24. A molded fiberglass product made using a method as in claim 22.

25. A method of charging a cavity in a mold with a fiberglass-binder mixture, the method comprising:

(a) making a mixture of fiberglass strand material and binder in a mixer;

(b) moving a charge of the fiberglass-binder mixture from the mixer into a conforming guide, wherein the mixture in the conforming guide has a relatively low density fluffy characteristic;

(c) as a first consolidating operation, driving a driver and engaging the low density fiberglass-binder mixture thereby and driving at least a portion of the low density mixture, into the mold;

(d) the method further comprising mounting the mold on a jig, the jig being mounted on a rotating table, the rotating table being mounted on a turntable, the jig having a driven gear which drives rotation of the rotating table and thus rotation of the mold, the method comprising rotating the turntable so as to move the mold under the mixer and to engage the driven gear with a drive gear and thereby drive rotation of the mold.

26. A method of charging a cavity in a mold with a fiberglass-binder mixture, the method comprising:

(a) making a mixture of fiberglass strand material and binder in a mixer;

(b) moving a first charge of the fiberglass-binder mixture from the mixer into a conforming guide;

(c) engaging the first charge of fiberglass-binder mixture and thereby driving at least a portion of the mixture into the cavity, and withdrawing the tamper, (d) further comprising determining mass of the first charge in the mold, computing a target add-on for a second charge based on the mass of the first charge, and feeding binder and fiberglass quantities to the mold according to the computed target add-on for the second charge.

27. A method as in claim 26 wherein the binder is a powdered binder material.

28. A molded fiberglass product made using a method as in claim 26.

29. A method of charging a cavity in a mold with a fiberglass-binder mixture, the method comprising:

(a) making a mixture of fiberglass strand material and binder in a mixer;

(b) moving a charge of the fiberglass-binder mixture from the mixer into a conforming guide, the charge comprising a discrete quantity of the mixture, wherein the mixture in the conforming guide has a relatively low density fluffy characteristic;

(c) as a first consolidating operation, driving a driver and engaging the low density fiberglass-binder mixture thereby and driving at least a portion of the low density mixture, into the mold; and (d) moving multiple such charges of the mixture into the mold while retaining all such charges in the mold, including stopping the feeding of the fiberglass and binder to the mixer and, while such feeding to the mixer is so stopped, initiating moving a respective such charge from the mixer into the conforming guide.

30. A molded figerglass muffler insert made according to a method as in claim 29.

31. A muffler assembly comprising a muffler insert made according to a method as in claim 29.

32. A method of fabricating a fiberglass-based muffler insert, comprising;

(a) chopping one or more fiberglass strand bundles and thereby obtaining chopped strand fiberglass;

(b) in flowing air, advancing the chopped strand fiberglass, and powdered binder material, into a mixer and using the flowing air to mix the binder and the chopped strand fiberglass in the mixer to make a fiberglass-binder mixture;

(c) shutting off air flow to the mixer and thereby causing a first charge of the mixture to drop out of the mixer;

(d) after the air flow has been shut off, driving a driver to the dropped mixture and thence into a cavity in a mold and thereby advancing the mixture into the mold; and (e) curing the binder and thereby creating a generally shape-constant muffler insert.

33. A method as in claim 32, the shutting off of air flow to the mixer causing the charge of the mixture to drop into an underlying conforming guide, further comprising driving the driver through the conforming guide and thus using the driver to drive elements of the mixture from the conforming guide and into the mold.

34. A method as in claim 32, the cavity in the mold having a top and a bottom, further comprising driving the driver into the mold, to approximately the bottom of the cavity, and executing a second driving of a driver into the mold and engaging the same first charge of the mixture including, in the process, moving the fiber-binder mixture to a relatively upper portion of the mold.

35. A method as in claim 34, further comprising moving a second charge of the fiberglass-binder mixture from the mixer into a conforming guide underlying the mixer and executing a third tamping operation on such second charge of the mixture.

36. A method as in claim 35, further comprising determining mass of the first charge in the mold, computing a target add-on amount for the second charge based on the mass of the first charge, and feeding binder and fiberglass quantities to the mold according to the computed target add-on for the second charge.

37. A muffler insert made according to a method as in claim 32.

38. A method of fabricating a fiberglass-based muffler insert, comprising:

(a) chopping one or more fiberglass strand bundles and thereby obtaining a discrete amount of chopped strand fiberglass;

(b) advancing the discrete amount of chopped strand fiberglass, and powdered binder material, into a mixer and entraining the binder and the chopped strand fiberglass in an air flow stream in the mixer and thus mixing the binder and fiberglass to make a low density fiberglass-binder mixture;

(c) dropping the charge of the mixture out of the mixer through open space without assistance of the air flow stream;

(d) moving the mixture into a mold; and (e) curing the binder in the mold and thereby creating a generally shape-constant muffler insert.

39. A muffler insert made according to a method as in claim 38.

40. A muffler assembly comprising a muffler insert made according to a method as in claim 38.

41. A method of fabricating a molded fiberglass product, comprising:

(a) feeding chopped fiberglass strand material and curable powdered binder into a mixer, and mixing the chopped fiberglass strand material and the binder in the mixer and thereby forming a fiberglass-binder mixture;

(b) releasing a discrete charge of the fiberglass-binder mixture from the mixer such that the fiberglass-binder mixture falls by force of gravity onto a conforming guide;

(c) receiving and consolidating the discrete charge of the mixture, which falls out of the mixer, onto the conforming guide;

(d) after the mixture is received on the conforming guide, engaging the mixture and moving the mixture into a mold; and (e) curing the curable binder while the fiberglass-binder mixture is in the mold to produce a cured, molded fiberglass product.

42. A method as in claim 35, the product having an outwardly-facing surface of the so-molded product, including opposing outwardly-facing end surfaces, further comprising enclosing the molded product in a plastic shrink film and shrinking the film about the molded product such that the film closely overlies substantially the entirety of the outwardly-facing surface, including the opposing outwardly-facing end surfaces.

43. A method as in claim 42 wherein the molded product comprises a muffler insert core.

44. A method as in claim 43 wherein the insert core has a bore extending therethrough, the bore having first and second opposing ends, the insert core thus having an inwardly facing surface facing across the bore, the method further comprising providing for apertures in the shrink film at the opposing ends of the bore.

45. A method as in claim 41 wherein the mixture falls out the bottom of the mixer.

46. A method as in claim 41 wherein the mixer comprises a cyclone mixer wherein the chopped fiberglass and the binder are mixed with each other by a flow of air passing through the mixer and the resultant mixture leaves the mixer as a result of the termination of the air flow.

47. A molded fiberglass product made according to a method as in claim 41.

48. A method of preparing a mixture of fiberglass strand material and curable binder, comprising:

(a) feeding chopped fiberglass strand material and curable powdered binder into a mixer;

(b) mixing the chopped fiberglass strand material and the curable binder in the mixer and thereby forming a fiberglass-binder mixture;

(c) receiving and consolidating the mixture in a mold, the consolidating of the mixture in the mold comprising (i) driving the mixture a first time by advancing a driver, to generally the bottom of the mold, (ii) retracting the driver, and (iii) advancing a driver a second time into the mold, and thus consolidating, the same mixture material a second time.

49. A method as in claim 42, further comprising, after consolidating the same mixture in the mold the first and second times, providing a second charge of the mixture to the mold and consolidating the composite of the first and second charges a third time.

50. A method as in claim 48, the advancing of the driver the second time comprising advancing the driver to generally the mid-point of the height of the mold.

51. A method as in claim 48, the advancing of the driver the second time moving at least a portion of the fiber-binder mixture into a relatively upper portion of the mold.

52. A method of preparing a mixture of fiberglass strand material and curable binder, comprising:

(a) feeding chopped fiberglass strand material and curable powdered binder into a mixer;

(b) mixing the chopped fiberglass strand material and the curable binder in the mixer and thereby forming a fiberglass-binder mixture;

(c) receiving and consolidating the mixture in a mold; and (d) providing multiple charges of the fiberglass-binder mixture to the mold in the process of charging the mold, and including rotating the mold between charges.

53. A method of charging a cavity in a mold with a fiberglass-binder mixture, the method comprising;

(a) chopping one or more fiberglass strand bundles and thereby obtaining chopped strand fiberglass, (b) advancing the chopped strand fiberglass and binder into a mixer, and mixing the fiberglass strand material and the binder in the mixer using a flow of air through the mixer, and terminating the flow of air through the mixer, thereby dropping the so-fabricated mixture from the mixer toward the mold;

(c) moving a charge of the fiberglass-binder mixture from the mixer into a conforming guide, wherein the mixture in the conforming guide has a relatively low density fluffy characteristic; and (c) driving a driver and engaging the low density fiberglass-binder mixture thereby and driving at least a portion of the low density mixture into the mold.

54. A molded fiberglass-binder product made according to a method as in claim 53.

55. A muffler assembly comprising a muffler insert made using a method as in claim 53.

56. A method of preparing a discrete charge of a mixture of fiberglass strand material and curable binder, comprising:

(a) entraining fiberglass strand material in a first air stream;

(b) entraining solid particulate binder in a second air stream;

(c) feeding the first and second air streams, including the fiberglass and binder, together into a mixer;

(d) using air flow of the first and second air streams, mixing the fiberglass strand material and the binder in the mixer and thereby forming the discrete charge of the fiberglass-binder mixture, dispersed and temporarily held in the mixer by the collective first and second air streams; and (e) shutting off air flow to the mixer, whereupon fiberglass and binder are no longer being fed to the mixer, and the discrete charge subsequently falls by gravity out of the mixer.

57. A method as in claim 56 the discrete charge falling by gravity out of the mixer into a conforming guide upon termination of the air flow, the method further comprising, after the air flow has been terminated, moving the mixture from the conforming guide into a mold.

58. A method as in claim 57, further comprising driving the charge of the mixture into the mold, and while the fiberglass-binder mixture is being driven into the mold, rotating the mold about an axis consistent with the direction in which the fiberglass mixture is being moved toward the mold.

59. A method as in claim 56, further comprising using a tamper to drive the mixture charge into an underlying mold.

60. A method as in claim 59, further comprising forming a second mixture charge in the mixer, dropping the second charge from the mixer and using a subsequent tamping operation to drive the second charge into a relatively upper portion of the mold.

61. A molded fiberglass product made using a method as in claim 56.

62. A muffler assembly comprising a muffler insert made according to a method as in claim 56.

* * * * *

UNITED STATES PATENT AND TRADEMARK OFFICE

CERTIFICATE OF CORRECTION

PATENT NO. : 8,336,673 B2
APPLICATION NO. : 12/803879
DATED : December 25, 2012
INVENTOR(S) : Daniel Zanzie et al.

It is certified that error appears in the above-identified patent and that said Letters Patent is hereby corrected as shown below:

In column 18, line 2, insert --to--, between "be able" and "conform to".

In column 20, line 27, Claim 13 remove "claim 5" after "A method as in" and replace with --claim 7--.

In column 21, line 35, Claim 25 insert --and-- after "mold;".

In column 21, line 52, Claim 26 insert --and-- after "tamper,".

In column 23, line 32, Claim 42 remove "claim 35" after "A method as in" and replace with --claim 41--.

In column 24, line 5, Claim 49 remove "claim 42" after "A method as in" and replace with --claim 48--.

Signed and Sealed this
Second Day of April, 2013

Teresa Stanek Rea
*Acting Director of the United States Patent and Trademark Office*